United States Patent [19]

Schloemann

[11] Patent Number: 4,521,753

[45] Date of Patent: Jun. 4, 1985

[54] TUNED RESONANT CIRCUIT UTILIZING A FERROMAGNETICALLY COUPLED INTERSTAGE LINE

[75] Inventor: Ernst F. R. A. Schloemann, Weston, Mass.

[73] Assignee: Raytheon Company, Lexington, Mass.

[21] Appl. No.: 446,532

[22] Filed: Dec. 3, 1982

[51] Int. Cl.[3] ..... H01P 1/203; H01P 1/218

[52] U.S. Cl. ..... 333/204; 333/24.1; 333/205; 333/222

[58] Field of Search ..... 333/1.1, 24.1, 24.2, 333/204, 205, 219, 223, 235, 222

[56] References Cited

U.S. PATENT DOCUMENTS

| | | | |
|---|---|---|---|
| 3,368,169 | 2/1968 | Carter et al. | 333/205 |
| 3,546,637 | 12/1970 | Wen | 333/205 |
| 3,560,893 | 2/1971 | Wen | 333/24.1 |
| 3,621,367 | 11/1971 | Rosen et al. | 333/204 X |
| 3,648,199 | 3/1972 | Buck et al. | 333/24.2 X |
| 3,713,210 | 1/1973 | Schellenberg | 29/593 |
| 3,740,675 | 6/1973 | Moore et al. | 333/205 |
| 3,771,075 | 11/1973 | Phelan | 333/246 |
| 3,838,367 | 9/1974 | Bex | 333/204 |

OTHER PUBLICATIONS

"Magnetically-Tunable Microwave Filters Using Single-Crystal Yttrium-Iron-Garnet Resonators" by Philip S. Carter.
IRE Transactions on Microwave Theory and Techniques, May 1961.

*Primary Examiner*—Paul Gensler
*Attorney, Agent, or Firm*—Denis G. Maloney; Richard M. Sharkansky; Joseph D. Pannone

[57] ABSTRACT

A magnetically tuned resonant circuit for selectively coupling radio frequency (r.f.) energy between an input coupling circuit and an output coupling circuit, dielectrically spaced from the input coupling circuit, through a resonant body disposed therebetween. Each coupling circuit includes a center strip conductor portion dielectrically spaced from a ground plane conductor. Such center strip conductor and ground plane conductor of each coupling circuit are formed on a common surface of a corresponding dielectric. The center strip conductor portions are orthogonally orientated, and have first end portions which are coaxially aligned and terminated with the ground plane. The resonant body is dielectrically supported between each one of such first end portions of such center conductors.

9 Claims, 47 Drawing Figures

FIG. 2
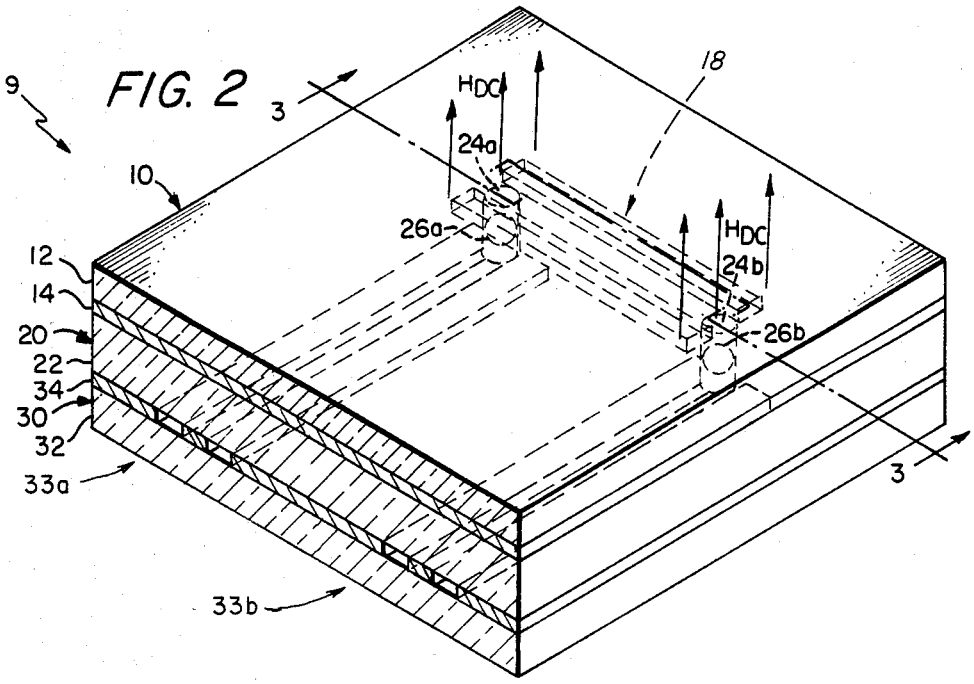
FIG. 3
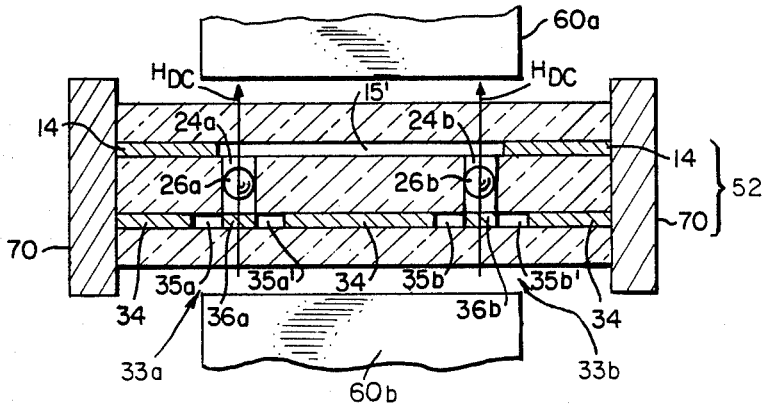
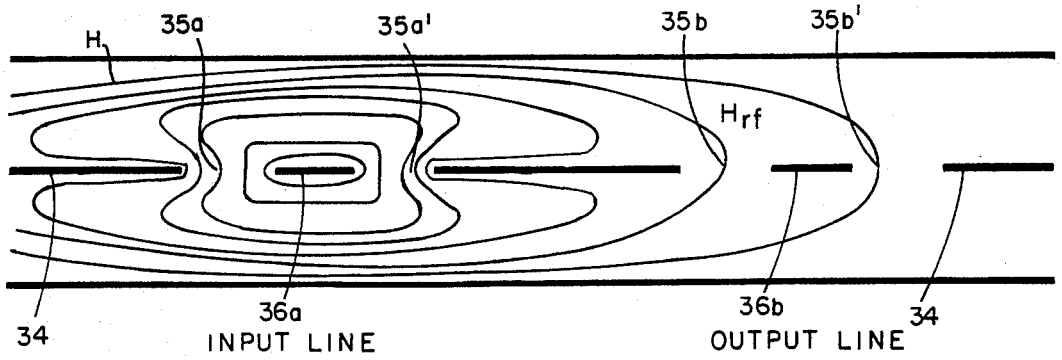
FIG. 4

FIG. 5
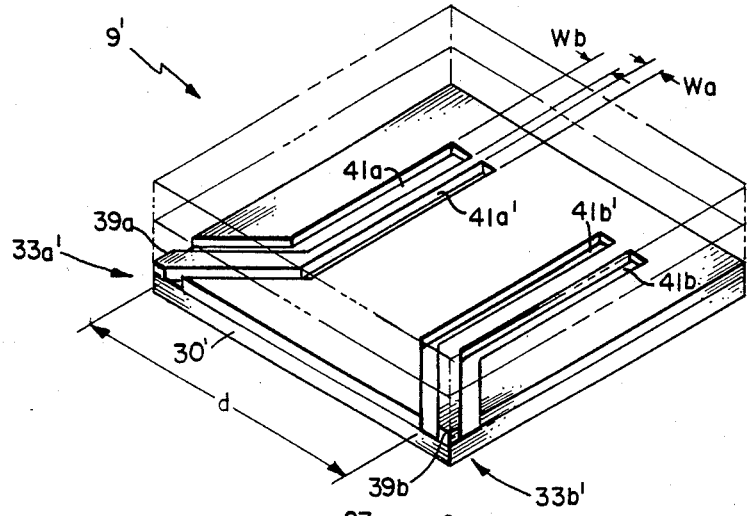
FIG. 6
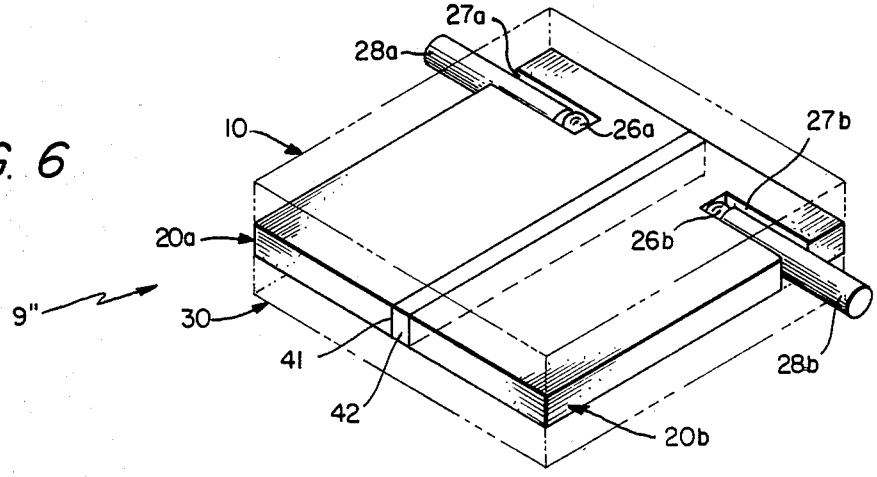
FIG. 7
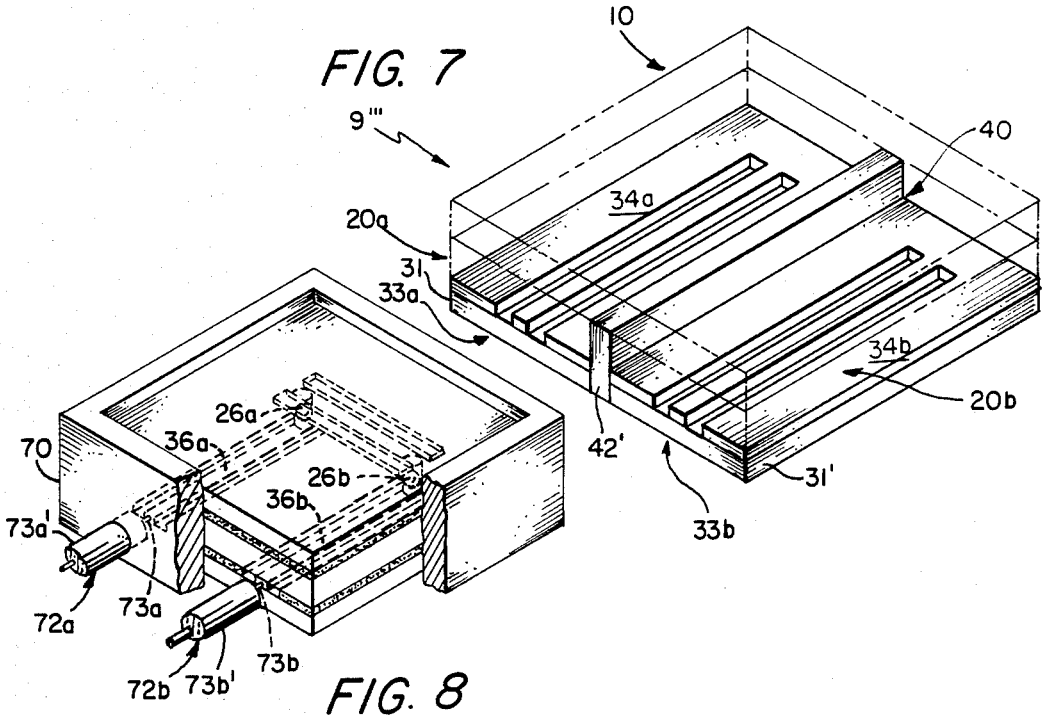
FIG. 8

FIG.13
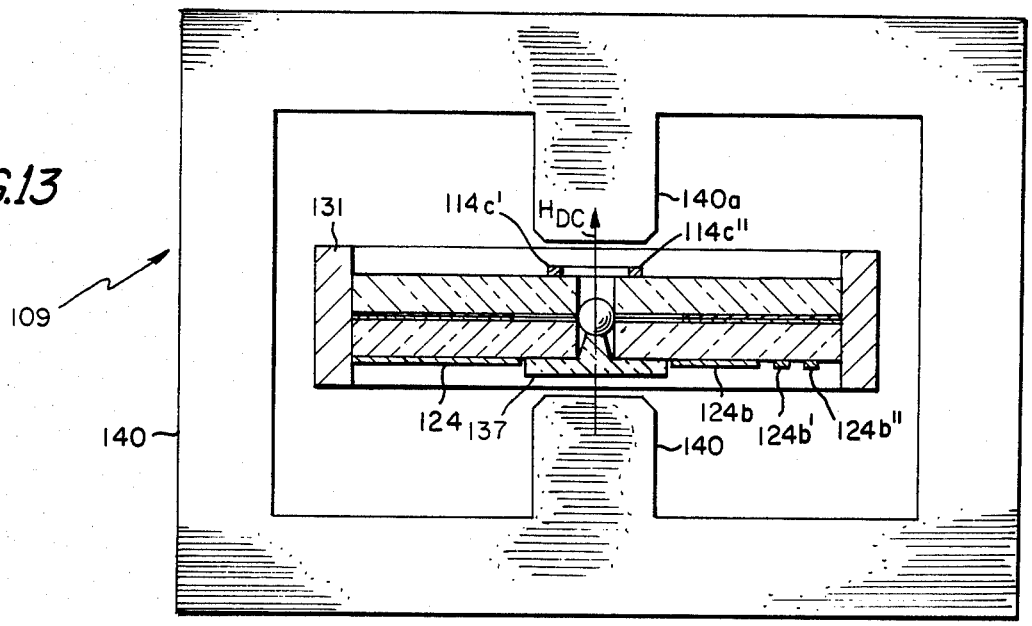
FIG.14
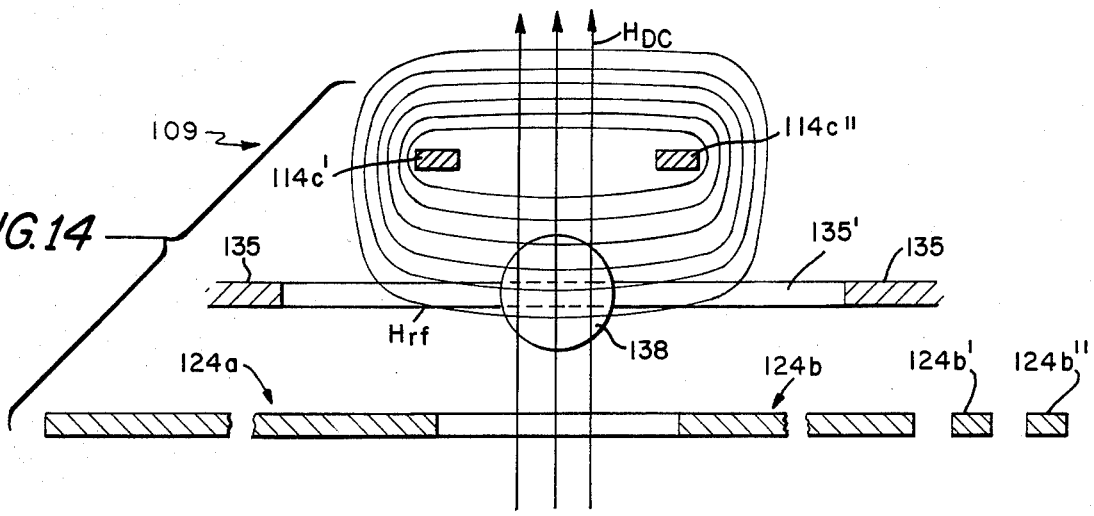
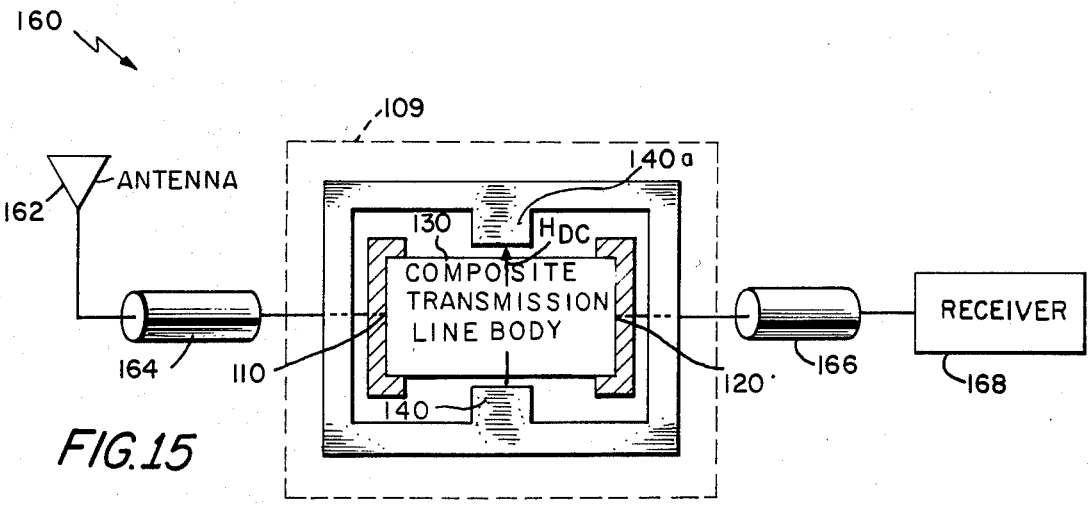
FIG.15

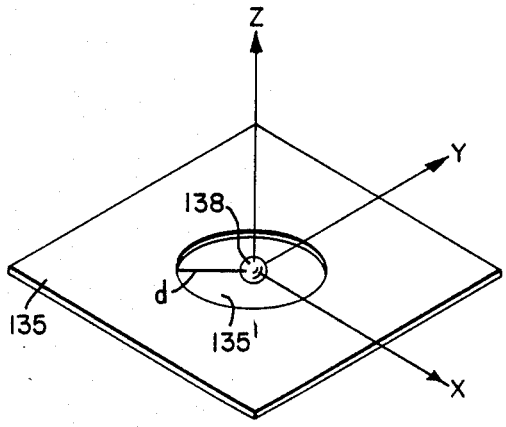
FIG.16
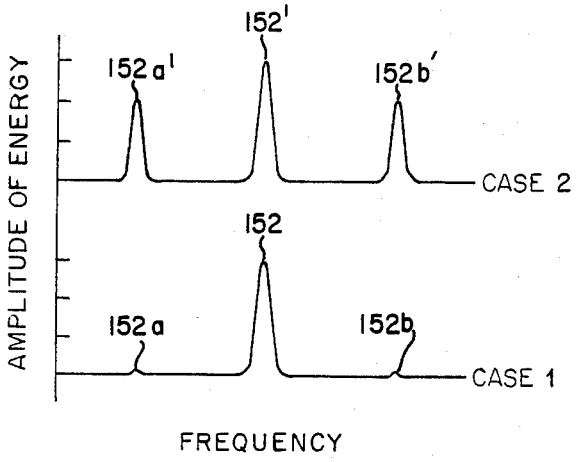
FIG.17A
FIG.17
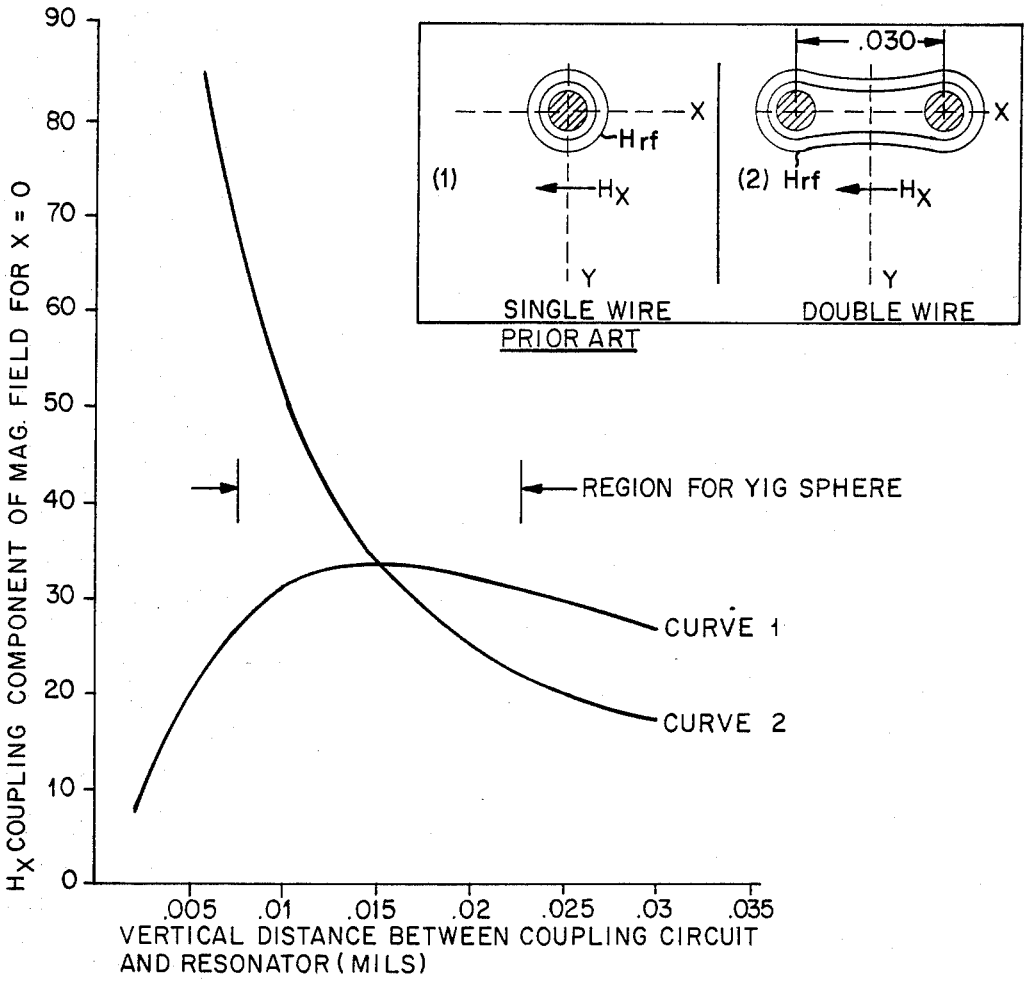

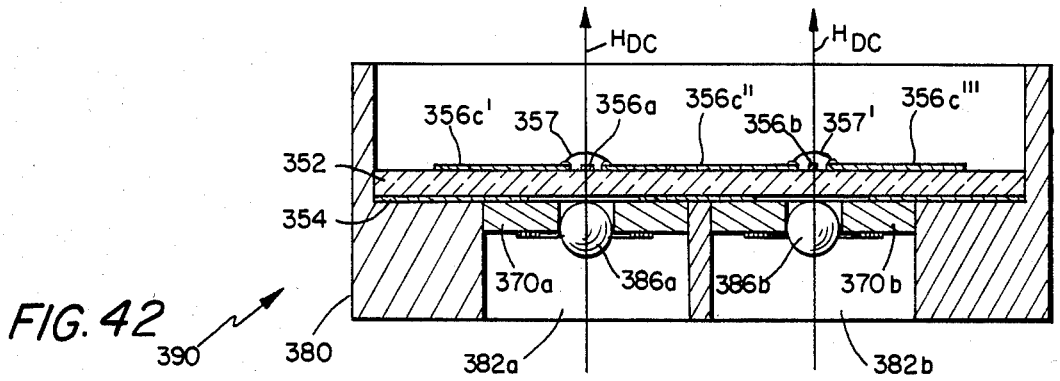
FIG. 42
FIG. 41
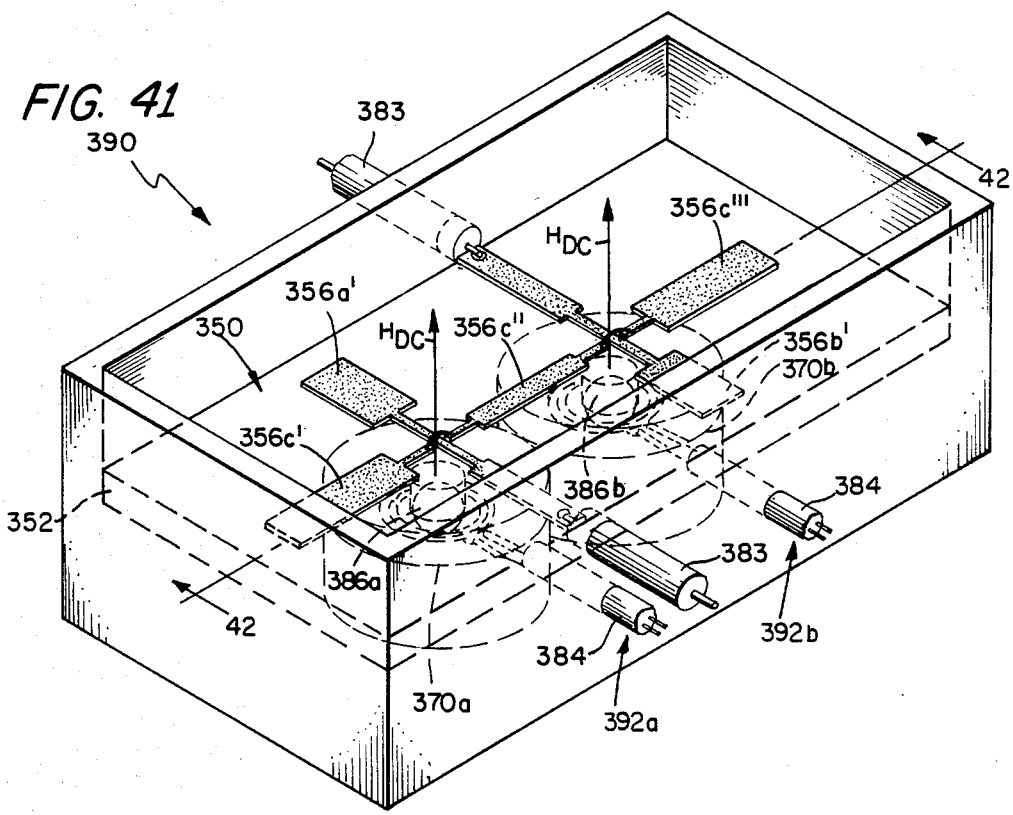

TUNED RESONANT CIRCUIT UTILIZING A FERROMAGNETICALLY COUPLED INTERSTAGE LINE

CROSS-REFERENCE TO RELATED APPLICATIONS

This application is related to application Ser. Nos. 446,530, 446,531 and 446,533, all application filed on Dec. 3, 1982.

BACKGROUND OF THE INVENTION

This invention relates generally to tuned radio frequency (r.f.) circuits and more particularly to tunable r.f. resonant circuits.

As is known in the art, tunable resonant circuits are often used in receiver applications, such as in a radar receiver system to filter out unwanted frequency components of a signal fed thereto. In particular, bandpass filters having a narrow frequency passband are often used in r.f. receivers. One approach used in the art to provide a tunable r.f. filter is the use of a resonant circuit including a pair of coupling circuits connected to input and output ports with a ferrimagnetic body disposed therebetween. A YIG sphere is often used as the ferrimagnetic body. The principle of operation with using a YIG sphere as the ferrimagnetic material is that, in the presence of an applied D.C. magnetic field $H_{DC}$, the YIG sphere of such material will provide a resonant circuit having a resonant frequency ($\omega_o$) given as $\omega_o=\gamma H_{DC}$ where $\gamma$ is a quantity referred to as the gyromagnetic ratio. When input energy is fed to an input one of such coupling circuits, a portion of such energy having a frequency related to the resonant frequency $\omega_o$ is coupled to an output one of such coupling circuits. Conventional coupling structures for such coupling circuits are machined from a metal such as brass and electroplated with a suitable metal such as gold to reduce ohmic losses. The machined coupling circuits are then assembled into a structure to form semi-circular structures orthogonally spaced from each other at the junction of an area where a YIG sphere is disposed. This technique is costly, labor intensive, and is a difficult technique to use in fabricating such circuits. Further, the semi-circular structure disposed around the resonator body makes external access to the resonator body difficult.

When a YIG sphere is disposed between a pair of coupling circuits in the presence of a magnetic field, the YIG sphere will provide a resonant frequency related to $\omega_o=\gamma H_{DC}$, at a particular temperature. An additional problem associated with such structures is that the resonant frequency of the resonator body in general is a strong function of variation in temperature and thus over the operating temperature range of such resonant circuit such resonant frequency will change. However, in certain orientations of the YIG sphere with respect to the applied d.c. magnetic field $H_{DC}$, the resonant frequency of the YIG sphere is independent of variations in temperature over a wide range of operating temperatures. Since the aforementioned coupling loops nearly surround the YIG's sphere in a conventional structure, it is difficult to insert therein an "orientated" sphere, further additional orientation of the sphere is generally required to compensate for mechanical variations inherent in such coupling loop structures. Further, because of the mechanical configuration of the prior art structures, it is sometimes difficult to orientate a sphere when disposed within such coupling loops.

SUMMARY OF THE INVENTION

In accordance with the present invention, a magnetically tuned resonant circuit includes a first strip conductor formed in a first plane dielectrically spaced from a ground plane and a second strip conductor having a portion formed in a second plane orthogonal to and dielectrically spaced from such first conductor and ground plane, has disposed therebetween a resonant body. With such an arrangement, a magnetically tuned resonant circuit may be fabricated using conventional photolithographic techniques to reduce the cost and complexity of manufacture of such circuits. Further, due to the inherently close tolerances achievable with photolithographic technology, a magnetically tuned resonant circuit having close mechanical tolerances is provided without the costly machining operations generally associated with such structures.

In accordance with one embodiment of the present invention, a magnetically tuned resonant circuit includes a pair of coplanar waveguide (CPW) transmission line sections. Each one of such CPW transmission line sections includes a dielectric substrate, supporting on a first surface thereof, a first center conductor dielectrically spaced from a ground plane conductor. The CPW transmission line sections are disposed for selectively coupling energy between the center conductors of each coplanar waveguide transmission lines through a resonant body disposed between such center conductors. With such an arrangement, a resonant body may be positioned a relatively small, precisely defined distance between such center conductors to facilitate coupling of r.f. energy between such conductors through the resonant body.

BRIEF DESCRIPTION OF THE DRAWINGS

The foregoing features of the invention, as well as the invention itself, may be more fully understood from the following detailed description read together with the accompanying drawings, in which:

FIG. 2 is an isometric view of the magnetically tuned resonant circuit shown in FIG. 1;

FIG. 3 is a cross-sectional view of FIG. 2 taken along lines 3—3;

FIG. 4 is a diagrammatical view depicting unwanted coupling of magnetic flux lines between input and output transmission lines of the magnetically tuned resonant circuit of FIG. 1;

FIGS. 5–7 are isometric views of alternate embodiments of the invention with parts common to FIGS. 1–3 shown in phantom;

FIG. 8 is an isometric view of the magnetically tuned resonant circuit of FIG. 2 disposed in a housing;

FIG. 13 is a cross-sectional view of FIG. 12 taken along lines 13—13 wherein the circuit is disposed between a magnetic pole piece and flux return yoke;

FIG. 14 is a diagrammatical view of FIG. 13 graphically showing the relationship of the r.f. magnetic fields and the resonant body;

FIG. 15 is a block diagram of a typical system application for a magnetically tuned resonant body, such as that shown in FIG. 3 or FIG. 13;

FIG. 16 is a diagrammatical view of a surface of the magnetically tuned resonant circuit, as shown in FIG. 13, detailing certain geometric relationships which are useful in understanding certain features of the invention;

FIGS. 17–17A are a series of graphs useful in understanding certain features of the invention;

FIG. 41 is an isometric view of the embodiment shown in FIG. 40;

FIG. 42 is a cross-sectional view of FIG. 41 taken along lines 42—42;

DESCRIPTION OF THE PREFERRED EMBODIMENT

Figure 1:
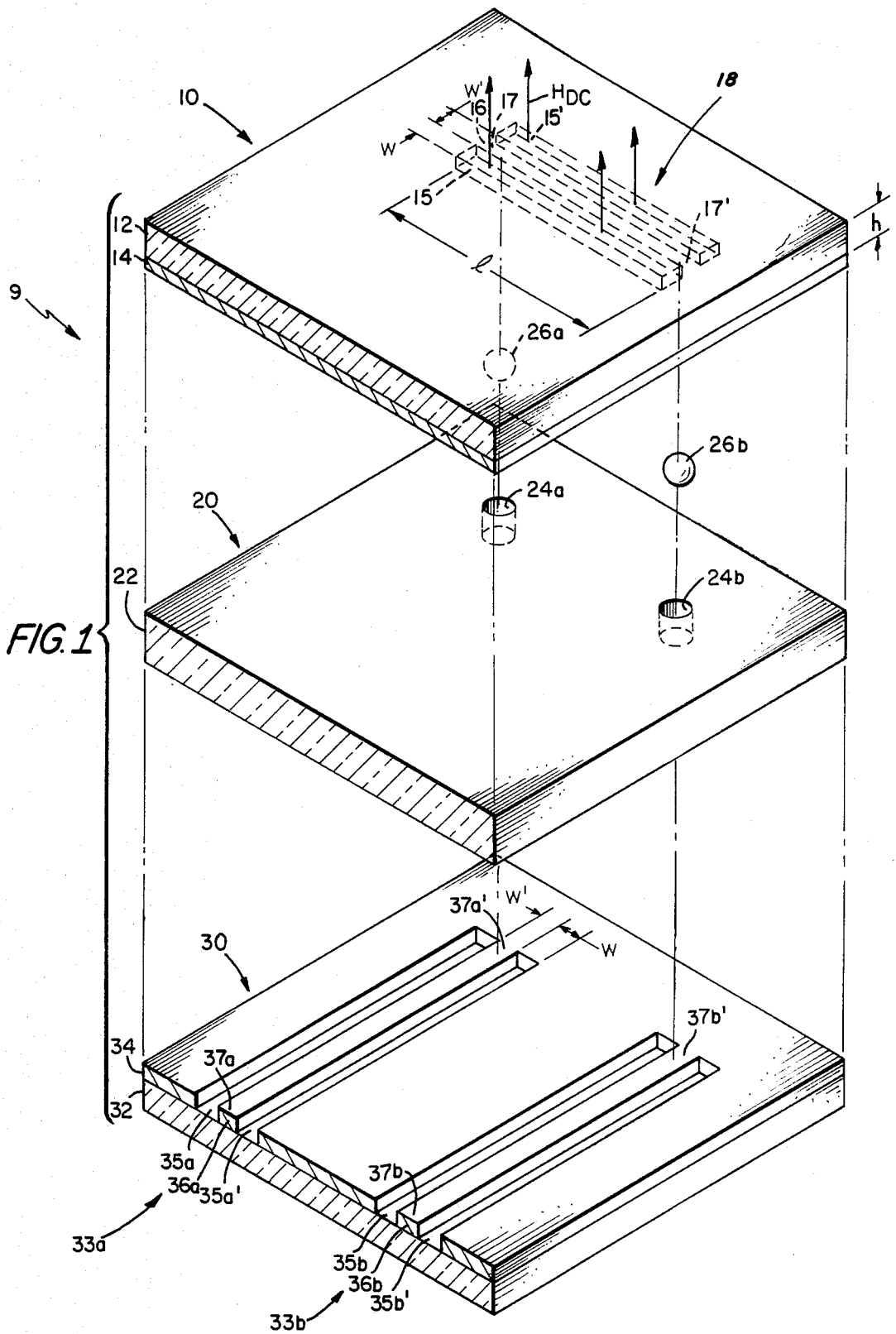
FIG. 1 is an exploded isometric view of a magnetically tuned resonant circuit.

Referring now to FIGS. 1–3, a dual-stage magnetically tuned resonant circuit 9 here a bandpass filter fabricated in accordance with the teachings of the present invention is shown.

Referring first to FIG. 1, the magnetically tuned resonant circuit 9 in the presence of a magnetic field $H_{DC}$ generated by disposing the circuit between a magnetic pole piece 60*a* (FIG. 3) and flux return yoke 60*b* (FIG. 3) is shown to include an input/output coplanar waveguide (CPW) transmission line section 30 having input CPW transmission line 33*a* and output CPW transmission line 33*b* formed on a common substrate 32, and an interstage CPW transmission line section 10 having an interstage CPW transmission line 18 formed on a substrate 12. Input transmission line 33*a* couples resonant energy to output transmission line 33*b* through a pair of spheres 26*a*, 26*b* comprised of a ferrimagnetic material and the interstage transmission line 18, in a manner to be described. The interstage coplanar waveguide (CPW) transmission line section 10 includes the dielectric substrate 12 and a ground plane conductor 14 formed on one surface thereof. The ground plane conductor 14 is plated out to the periphery of the dielectric 12 to provide continuity between the ground plane 14 and a housing 70 such as shown in FIGS. 3 and 8. Selected portions of the ground plane conductor 14 are removed to expose underlying portions of the substrate 12 and thus provide a pair of elongated, parallel slots 15, 15′ in such ground plane 14 using conventional photolithographic masking and etching techniques. Such slots 15, 15′ have a width w, and a length l. The slots 15, 15′ are separated by an unetched portion of the ground plane conductor 14, here an elongated strip conductor portion 16 having a width w′. The strip conductor portion 16 is here formed integrally with the ground plane conductor 14 to provide short circuits at each terminal portion 17, 17′ of the elongated strip conductor region 16.

Terminations of the strip conductor portion 16 to the ground plane 14 are provided here in order to generate a current maximum so as to maximize the magnetic field component of electromagnetic energy propagating along such CPW transmission line section 10 in a manner to be described hereinafter. Suffice it to say here, however, that the width w of each slot 15, 15′ in the ground plane conductor 14, the thickness h and dielectric constant of the substrate 12 and the width w' of the strip conductor portion 16 are chosen to provide the CPW transmission line 10 with a predetermined characteristic impedance $Z_o$, as is well-known in the art.

The magnetically tuned resonant circuit 9 is shown to further include a dielectric spacer 20, here a dielectric substrate 22, having a thickness substantially equal to the thickness of the aforementioned substrate 12 and having a pair of apertures 24a, 24b provided through a portion of the substrate 22. The pair of ferrimagnetic spheres 26a, 26b are predisposed in such apertures 24a, 24b. The first ferrimagnetic sphere 26a is chosen to be comprised of a pure single crystal of yttrium iron garnet (YIG), and the second sphere 26b is chosen to be comprised of a doped single crystal of yttrium iron garnet. The second YIG sphere 26b is here suitably doped with a dopant such as gallium, in order to change the saturation magnetization of such sphere in order to suppress unwanted spurious energy which may be coupled through such magnetically tuned resonant circuit 9, as is known in the art.

The magnetically tuned resonant circuit 9 is shown to also include an input/output (I/O) CPW transmission line section 30. I/O transmission line section 30 is shown to include a ground plane conductor 34 formed on a first surface of a dielectric substrate 32. Thus, substrates 12, 22 and 32 provide a composite dielectric support structure. The ground plane conductor 34 is plated out to the periphery of the dielectric substrate 32 to provide continuity between the ground plane 34, the ground plane 14 and the housing 70 (FIGS. 3,8). Thus, a composite ground plane conductor 52 is provided as shown in FIG. 3. Selective portions of the ground plane conductor 34 are removed to expose underlying portions of the substrate 32, providing elongated parallel slots 35a, 35a' and 35b, 35b' in such ground plane conductor 14, each one of such slots 35a, 35a', 35b, 35b' here having a width W. In a similar manner as described above, here pairs of such slots 35a, 35a' and 35b' 35b' provide one of a pair of elongated strip conductor portions 36a, 36b formed from unetched portions of the ground plane conductor 34 disposed between slots 35a, 35a', 35b, 35b'. Each one of such strip conductors has a first end 37a, 37b, here terminated at the edge portion of the substrate for external connection, and a second end 37a', 37b' terminated in said ground plane conductor 34. In a similar manner as previously described, the ends 37a', 37b' of each one of such strip conductors 36a, 36b is terminated with the ground plane 34 to provide at such ends 37a', 37b' a short circuit in order to maximize current at such ends 37a', 37b' and hence to maximize at such ends 37a', 37b' the magnetic field component of such electromagnetic energy propagating between such strip conductors 36a, 36b and ground plane conductor 34 in order to strongly couple the magnetic field component of such energy in a manner to be described. As also previously described, the width W of each slot 35a, 35a', 35b, 35b' in the ground plane conductor 34, the thickness and dielectric constant of the substrate 32, and the width w' of each strip conductor portion 36a, 36b are chosen to provide each one of the pair of CPW transmission lines 33a, 33b with a predetermined characteristic impedance $Z_o$, as is well-known in the art.

As shown in FIGS. 2, 3, the interstage CPW transmission line 10 is joined with the dielectric substrate 22 having the YIG spheres 26a, 26b mounted therein such as with a suitable low loss epoxy, and the input/output transmission line section 30. Each of such substrates 12, 22 and 32 are arranged such that each YIG sphere 26a, 26b disposed within such corresponding aperture 24a, 24b is coaxially aligned, and disposed adjacent the terminations 37a', 37b' of strip conductor portions 36a, 36b in the ground plane 34 of input transmission line 33a and output transmission line 33b, and with the terminations 17, 17' of the strip conductor portions 16 of interstage CPW transmission line section 10. The substrates 12, 22 and 32 are further arranged such that strip conductor portion 36a of input transmission line 33a is orthogonally aligned with strip conductor portion 16 of interstage transmission line section 10, and strip conductor portion 36b of output transmission line 33b is likewise orthogonally aligned with the strip conductor 16 of interstage transmission line 10. Further, the apertures 24a, 24b provided in interstage substrate 22 are aligned with the region wherein the aforementioned strip conductors orthogonally cross each other. As previously described, YIG spheres 26a, 26b are disposed in the apertures 24a, 24b prior to assembly of the substrates 12, 22, 32 into the magnetically tuned resonant circuit 9. Preferably, such YIG spheres 26a, 26b are orientated to provide a predetermined relationship between a selected crystallographic direction of such YIG spheres 26a, 26b and the external magnetic field $H_{DC}$, in order to reduce variations in a radian resonant frequency ($\omega_o$) of such spheres 26a, 26b, in the presence of such magnetic field $H_{DC}$, with variations in external temperature. Any method to provide an orientated YIG sphere 26a, 26b may be used. A preferred procedure is described hereinafter in conjunction with FIG. 43 to FIG. 45.

Coupling of a selected portion of a radio frequency signal fed to strip conductor portion 36a of input transmission line 33a to strip conductor portion 36b of output transmission line 33b will now be described. As shown in FIG. 3, the external dc magnetic field $H_{DC}$ is generated by disposing the magnetically tuned resonant circuit 9 between a magnetic pole piece 60a, connected to a magnetic flux return yoke 60b (a portion shown) with such field $H_{DC}$ being applied normal to the surface of the ground plane conductors 14, 34 of the magnetically tuned resonant circuit 9. Radio frequency energy in the presence of the dc magnetic field $H_{DC}$ is fed to here input CPW transmission line 33a, via a connector 72a (FIG. 8). As previously described, a short circuit is provided at the opposite end of strip conductor 36a by integrally forming or terminating such strip conductor 36a with the ground plane conductor 34. A short circuit is provided in such region in order to strongly couple the magnetic field component of the radio frequency energy fed to the input transmission line section through the YIG sphere 26a and to the interstage transmission line section 10. In the absence of a YIG sphere disposed in aperture 24a, 24b, input radio frequency energy fed to strip conductor 36a is not coupled to the interstage transmission line 10 since the input transmission line 36a and the interstage transmission line 16 are orthogonally oriented with respect to each other. With the YIG sphere disposed in aperture 24a, a portion of the energy fed on the strip conductor 36a is absorbed by the YIG sphere 26a. The radian frequency $\omega_o$ (hereinafter frequency) of this absorbed energy is given as $\omega_o = \gamma H_{DC}$ where $\gamma$ is a quantity referred to as, "the gyromagnetic ratio" and is defined as the ratio of angular momentum and magnetic moment of a spinning electron in a crystal of a ferrimagnetic material in the presence of an applied dc magnetic field, and $H_{DC}$ is the magnitude of the applied dc magnetic field, as previously described. Nonresonant frequency energy which is not absorbed by the YIG sphere 26*a* is reflected backwards toward the input source. Energy transfer between the input transmission line section 33*a* and the YIG sphere 26*a* is thus possible when the frequency $\omega_i$ of the input radio frequency signal fed thereto is equal to the natural resonant frequency $\omega_o$ of the YIG sphere as defined by the equation $\omega_i=\omega_o$. When this resonant condition is satisfied ($\omega_i=\omega_o$), the magnetic field component $H_x$ of input energy fed to the input transmission line 33*a* having a frequency near the resonant frequency $\omega_o$ is coupled to the spins of the electrons in the YIG sphere 26*a* by making the electrons precess about their Z axis. Precession of the electrons about their Z axis produces, in response thereto, a radio frequency magnetic moment about their Y axis, enabling coupling of radio frequency energy to interstage transmission line section 10 along strip conductor portion 16 which is disposed along the Y axis. Provided at a first end 17 of strip conductor portion 16 is a second short circuit again used to strongly couple the magnetic field component of the radio frequency energy coupled through the YIG sphere 26*a*, as previously described. There is also some transfer of energy having a frequency which deviates from $\omega_o$, the resonant frequency. The strength of coupling of such energy and hence the bandwidth of the coupling thereof is determined by the proximity of the frequency of such energy to the resonant frequency. Radio frequency energy coupled to strip conductor 16 of interstage transmission line section 10 propagates between the strip conductor portion 16 and the ground plane 14 to the region of strip conductor portion 16 where there is a second short and where the second YIG sphere 26*b* is disposed in the aperture 24*b* provided in the substrate 22. As previously described, a short circuit is provided at the end 17' of strip conductor 16 to strongly couple the magnetic field component of the radio frequency energy fed thereto. In a similar manner, as previously described, substantially all the energy fed along strip conductor 16 is transferred to the spins of the electrons in the second YIG sphere 26*b* and, in a similar manner, as previously described, such energy is then coupled to strip conductor 36*b* of output transmission line section 33*b*.

As is well-known in the art, the resonant frequency of the YIG sphere in the presence of a dc magnetic field $H_{DC}$ is a strong function of variations in temperature for most orientations of the YIG sphere crystallographic structure as previously described. However, along selected well-known orientations of the YIG sphere's crystallographic structure with respect to the magnetic field $H_{DC}$, such resonant frequency is substantially invariant with temperature variations over a wide operating range of temperature. Thus, the YIG spheres are here orientated along one of such preferred crystallographic orientations, prior to disposing them in such apertures 24*a*, 24*b*. Since the above-described coupling structures are planar structures fabricated using photolithographic techniques, the YIG sphere may be orientated prior to insertion in the filter. Thus, such YIG spheres may be orientated in relatively large numbers to facilitate YIG filter fabrication unlike prior art structures where, due to the uncertainties of the spatial arrangement of the loop type coupling circuit, such preorientation of a YIG sphere was generally not possible.

Referring now to FIGS. 5, 6 and 7, alternate embodiments of the magnetically tuned resonant circuit 9 are shown. As shown in FIG. 5, an alternate embodiment 9' includes an input/output transmission line section 30' joined with the interstage section 10 (FIG. 1) shown in phantom and dielectric YIG spacer 20 (FIG. 1) shown in phantom. Here input/output transmission line section 30' is used to provide reduced direct coupling of r.f. energy fed on input line 33*a'* to output line 33*b'*. Such direct coupling may occur for certain applications of the embodiment shown in FIGS. 1–3. Whether this coupling is tolerable is dependent upon the amount of coupling in comparison to the system requirements. The distance between the lines 33*a*, 33*b*, the frequency of the energy fed thereto and the power level are some factors which will influence direct coupling between lines 33*a*, 33*b*. Therefore, the second embodiment 9' is shown which provides reduced direct coupling. This is accomplished by having such lines diverge at terminal portions 39*a*, 39*b* thereof, as shown, to thereby increase the distance between such lines and thus reducing coupling of a voltage induced between such lines in accordance with $1/d^2$ where d is the distance separating such lines. Such direct coupling is further reduced by making innermost slots 41*a'*, 41*b'* narrower in width $w_a$ than the widths $w_b$ of outer slots 41*a*, 41*b*. As shown in FIG. 4, direct coupling may occur when an input signal, for example, propagates on input line 33*a* and a voltage is induced in strip conductor 36*b* of output line 33*b*, because some of the magnetic flux lines (representing the propagation magnetic field component of the input signal) extend outwardly in the vicinity of the output strip conductor 36*b*. Due to the nature of CPW transmission line propagation, a difference in magnetic flux which passes through each one of such gaps in the metallization induces a voltage in such output line 33*b* proportional to such difference. That is, since the flux in each gap will induce a voltage in the strip conductor, with each one of such voltages 180° out of phase with each other, the net current flowing in such strip conductor will be the difference between the individual components of such current. Thus, if the gaps are equally wide, coupling will occur because the magnetic flux will decrease with increasing distance and the distant or outmost slot will have relatively low amounts of flux therethrough than the inner slot, and the net current will not be zero. The reduced width of inner slots 41*a'*, 41*b'* results in reduced direct coupling if equal currents are induced in each direction, so that the resultant current will be zero and no energy will be coupled into the output strip conductor 36*b* from the input strip conductor 36*a*. With the magnetically tuned resonant circuit 9' (FIG. 5) the inner slot is made sufficiently narrow (or conversely the outer slot is made sufficiently wide) so as to reduce the amount of magnetic flux therein to be substantially equal to the magnetic flux in the outer slot, the difference in such flux will be substantially zero and substantial isolation between input and output lines 33*a'*, 33*b'* will be obtained.

Referring now to FIG. 6, an alternate embodiment of a magnetically tuned resonant circuit 9'' is shown to include a pair of dielectric spacers 20*a*, 20*b* used to hold in place the YIG spheres 26*a*, 26*b*. Here such spacers 20*a*, 20*b* are joined to interstage section 10 and input/output section 30 to provide a slot 41 for slidably disposing therein a conductor stub 42 for increasing isolation between YIG spheres 26*a* and 26*b*. Further, here each dielectric support has formed therein a slot 27*a*, 27*b* to slidably dispose therein the YIG spheres 26*a*, 26*b* which are connected to end portions of dielectric rods 28*a*, 28*b* as shown. Final precise adjustments of the YIG spheres about the axis may be made with this structure.

Referring now to FIG. 7, an alternate embodiment of a magnetically tuned resonant circuit 9''' is shown to include a pair of substrates 31, 31' here replacing the input/output substrate 30 of the prior embodiments 9, 9', 9'', as shown. Each substrate 31, 31' has formed thereon a ground plane conductor 34*a*, 34*b* and has formed therefrom a corresponding one of such input or output CPW transmission lines 33*a*, 33*b*. Such substrates are joined with pairs of dielectric spacers 20*a*, 20*b* (FIG. 6) as shown. When joined with the dielectric spacers 20*a*, 20*b*, a channel 40 is provided therebetween, such channel 40 is here provided to slide therein a conductive slab 42' such that the input line 33*a* is isolated from the output line 33*b* and the YIG spheres 24*a*, 24*b* are isolated. Edge portions (not shown) of substrate 31, 31' may be plated and formed integrally with the ground plane conductors 34*a*, 34*b* to insure continuity of the slab 42 with the ground planes 34*a*, 34*b*.

Referring now to FIG. 8, the magnetically tuned resonant circuit 9 is shown disposed in a housing 70, here of brass. Connected to such housing 70 are a pair of coaxial transmission line connectors 72*a*, 72*b* having center conductors 73*a*, 73*b* dielectrically spaced from outer conductors 73*a*', 73*b*'. The center conductors are connected to the strip conductor portions 36*a*, 36*b*, and the outer conductors 73*a*', 73*b*' are connected to the housing 70 to provide input and output connections to the magnetically tuned resonant circuit 9.

Figure 9:
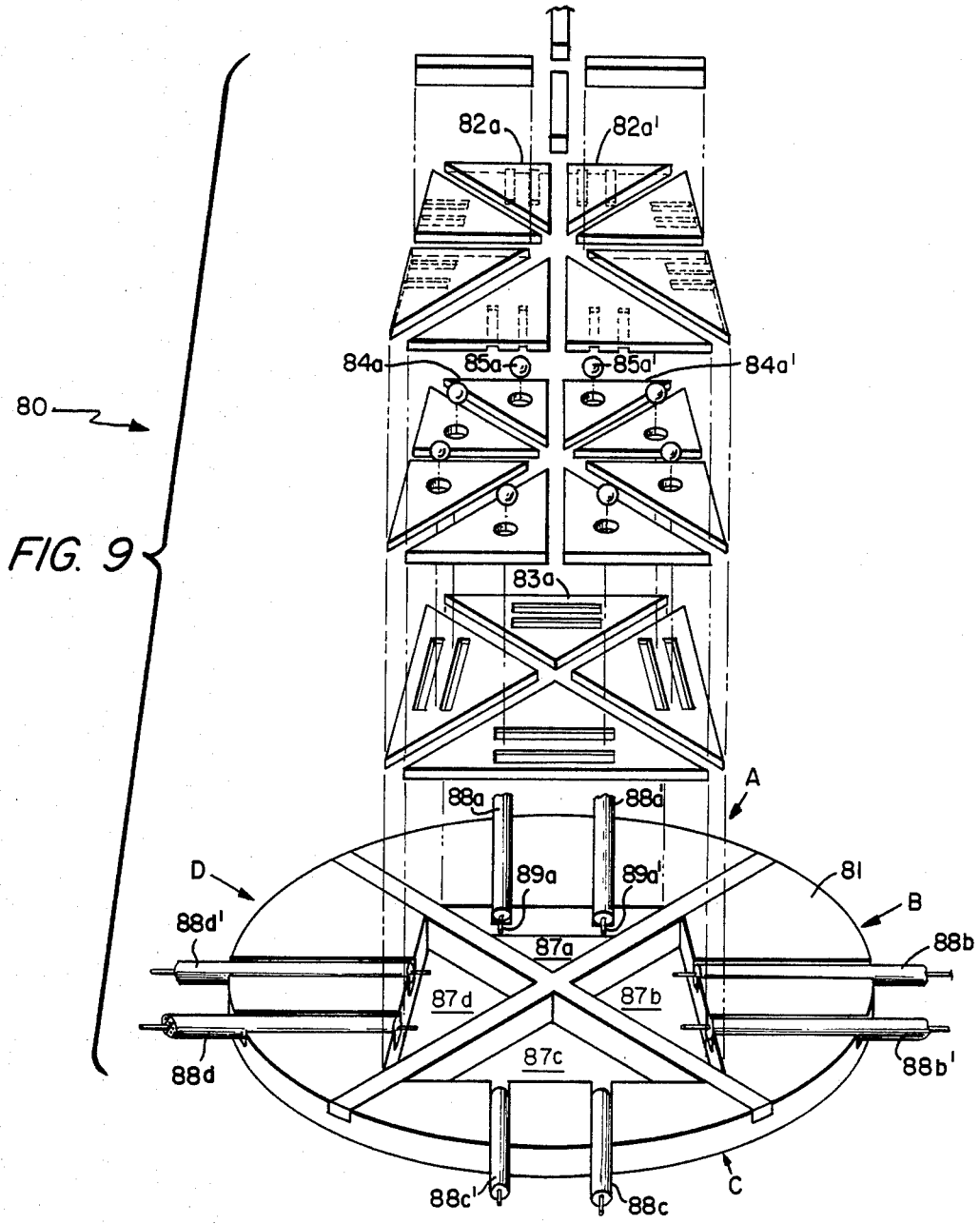
FIG. 9 is an exploded isometric view of a four channel dual-stage filter.
Figure 10:
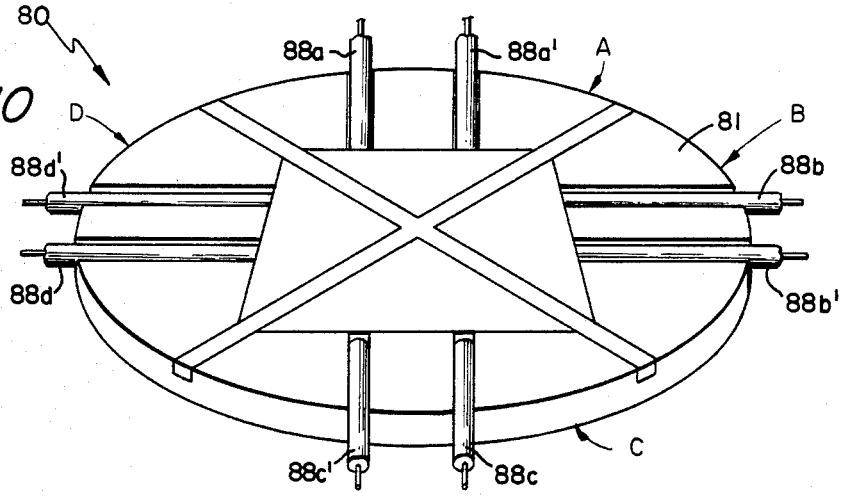
FIG. 10 is an isometric view of the magnetically tuned resonant circuit shown in FIG. 9.

Referring now to FIGS. 9, 10, fabrication of a four channel dual stage filter 80 will be briefly described. One channel A of the four channel dual stage filter 80 is shown to include a first triangular shaped CPW transmission line section 82*a*, a second triangular shaped CPW transmission line section 82*a*', spacers 84*a*, 84*a*', YIG spheres 85*a*, 85*a*' and interstage section 83*a* disposed in a slot 87*a* of a housing 81. Such CPW sections are fabricated in a similar manner as described in conjunction with FIGS. 1–3. Coaxial lines 88*a*, 88*a*' having center conductors 89*a*, 89*a*' are connected to the first and second lines 82*a*, 82*a*' as described in conjunction with FIG. 8. In a like manner, each one of the remaining slots 87*b*–87*d* of housing 81 has disposed therein a similar set of such CPW, transmission line sections, and spacers (not numbered) providing in combination additional channels B-D. With the above structure a relatively compact, multi-channel filter is provided.

Figure 11:
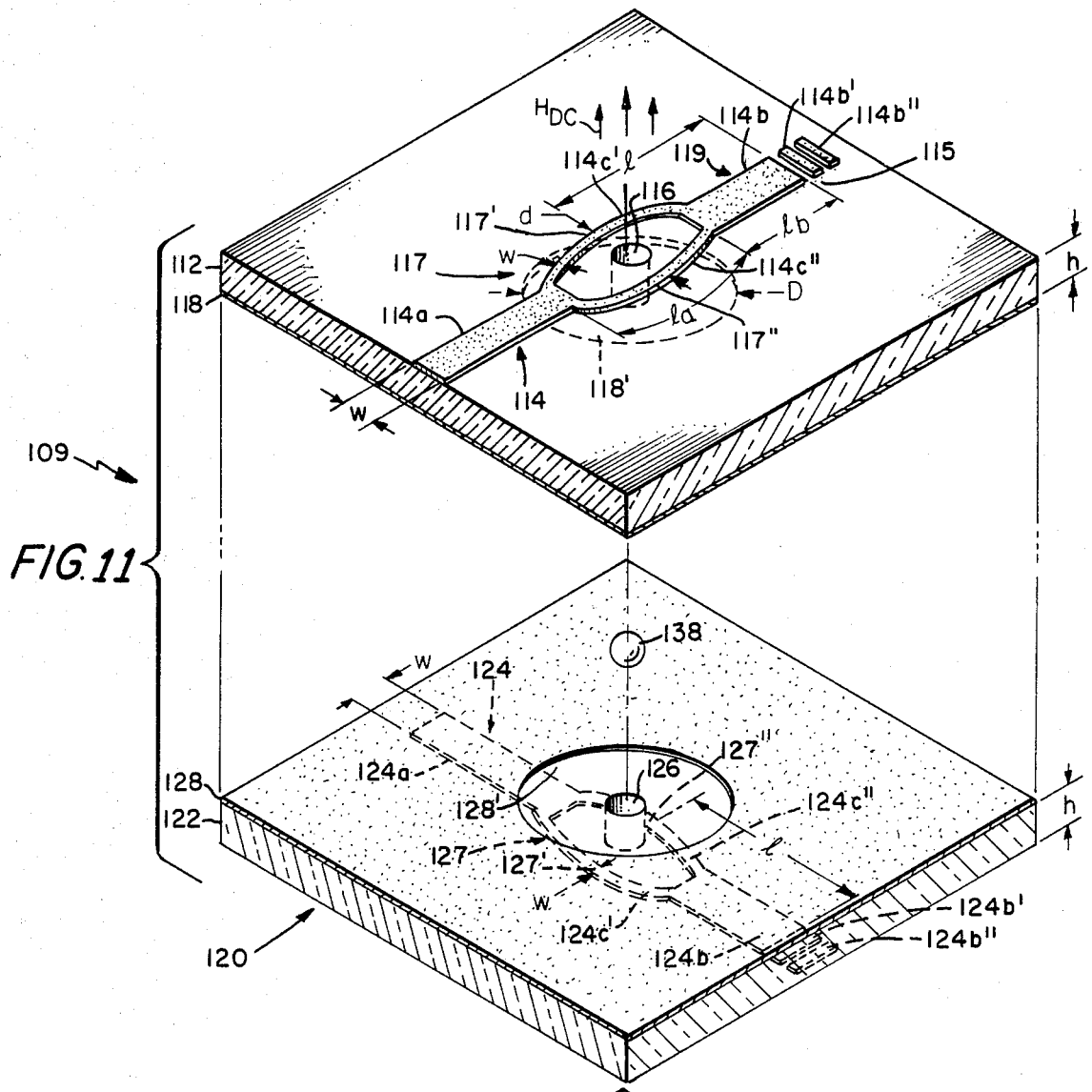
FIG. 11 is an exploded isometric view of a magnetically tuned resonant circuit having coupling circuits for selectively shaping an r.f. magnetic field in the region adjacent a resonant body.
Figure 12:
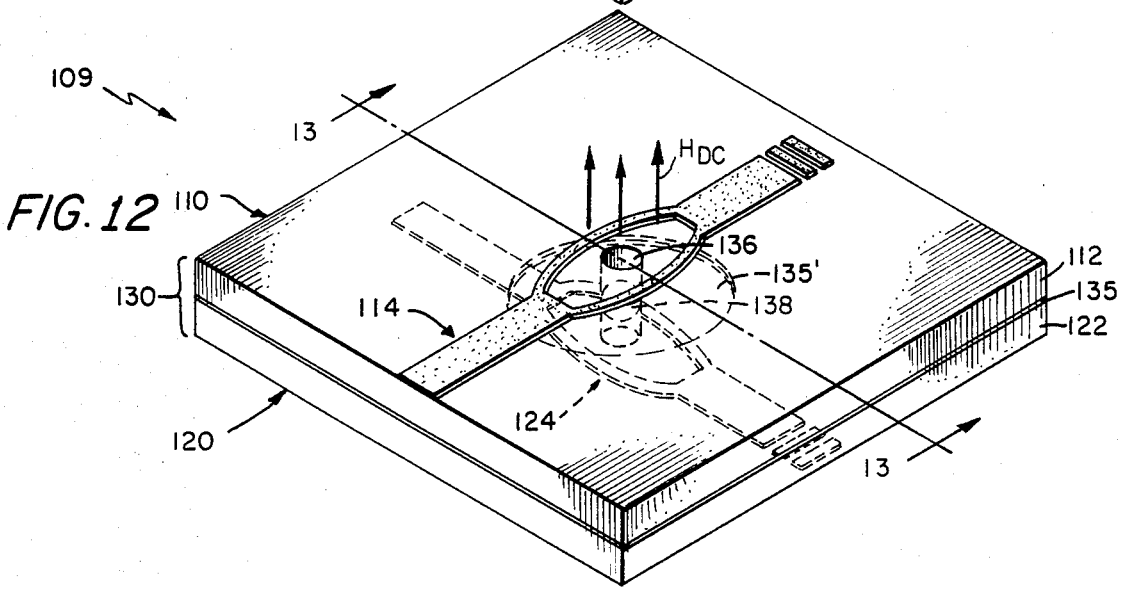
FIG. 12 is an isometric view of the magnetically tuned resonant circuit shown in FIG. 11.

Referring now to FIGS. 11–13, a magnetically tuned resonant circuit 109, here a bandpass filter, having improved resonant circuit characteristics fabricated in accordance with the teachings of the present invention is shown.

Referring first to FIG. 11, the magnetically tuned resonant circuit 109 is shown in the presence of a DC magnetic field intensity $H_{DC}$, generated by means, not shown. The magnetically tuned resonant circuit 109 includes a first, here input, microstrip transmission line section 110 having a dielectric substrate 112 separating a ground plane conductor 118 and a strip conductor 114. The strip conductor 114 has a first portion 114*a* of an arbitrary length and a second portion 114*b*. Strip conductor portions 114*a* and 114*b* are connected together by a pair of outwardly bowed spaced strip conductors 114*c*', 114*c*'', here of equal arc lengths, $l_a$, as shown. Outward bowed spaced strip conductors 114*c*', 114*c*'' here provide a planar input r.f. coupling circuit 117 (it is to be noted that the strip conductors 114*c*', 114*c*'' are spaced a distance d).

In order to strongly couple the magnetic field component of an r.f energy signal fed to coupling circuit 117, an effective r.f. short circuit is provided at midpoint 117', 117'' thereof. To provide such short circuit, the length of strip conductor portion 114*b* $l_b$ is chosen to provide, in combination with a portion of the arc length of either one of strip conductors 114*c*', 114*c*'' to the midpoint 117', 117'' of the coupling circuit 117, a length $l=l_b+(l_a/2)$ substantially equal to one quarter of a wavelength ($\lambda/4$) where $\lambda$ is the wavelength of the midband frequency component of the resonant circuit. Further, portion 114*b* of strip conductor 114 has a plurality of spaced strip conductor segments 114*b*', 114*b*'' formed adjacent thereto. The spaced strip conductor segments 114*b*', 114*b*'' are used to extend the length of the strip conductor portion 114*b* for lower frequency applications by selectively bonding one or more of such segments 114*b*', 114*b*'' together and to the strip conductor portion 114*b* by conductors (not shown) to thereby provide the requisite length $l=\lambda/4$. Strip conductor portion 114*b* is here terminated in an open circuit at the segment end 115 thereof to provide, at the midpoints 117', 117'' respectively of the coupling circuit 117, an effective short circuit to such r.f. energy, as is known in the art, since the separation between the open circuit end 115 and the midpoint of the coupling circuit is a quarter of a wavelength. A short circuit is thus created at the midpoint 117', 117'' of each one of the spaced conductors 114*a*', 114*a*'' of the coupling circuit 117. The impedance of a stub 119 (such stub being formed from the strip conductor 114*b*, the dielectric 112 and ground plane 118) is selected to provide the resonant circuit 109 with a desired bandwidth. As is known in the art, the impedance $Z_{110}$ of such a microstrip transmission line section 110 at the midpoint 117' is related to the characteristic impedance ($Z_o$) of the stub 119, operating wavelength $\lambda$ and length $l_a$ of such a stub 119 by $Z_{110}=-jZ_o$ cotangent $(2\pi l_a/\lambda)$. Thus, the lower the characteristic impedance $Z_o$ the broader the operating bandwidth since there will be a wider range of wavelengths for which $Z_{110}$ will be substantially equal to zero (appear as a short circuit) and thus strongly couple the magnetic field component of such signal in a manner to be described.

A circular aperture 116 is bored through the substrate 112 and ground plane conductor 118, symmetrically between the spaced strip conductor portions 114*c*', 114*c*''. A circular void 118' is formed in the portion of the ground plane 118 using conventional masking and etching techniques, exposing an underlying portion of the substrate 112. The void 118' and the aperture 116 are here concentric. Here the void 118' exposes a portion of the substrate 112 extended beyond the periphery of the strip conductors 114*c*', 114*c*'' whereas the aperture 116 is here substantially confined to the region between such strip conductors 114*c*', 114*c*'', as shown more clearly in FIG. 13, and to be described in more detail hereinafter.

The width (w) of the strip conductor 114*a*, and the thickness (h) and dielectric constant of the substrate 112 are chosen to provide in combination with the ground plane 118 the microstrip transmission line section 110 having a predetermined characteristic impedance $Z_o$, here equal to 50 ohms. The width w' of spaced conductors 114*c*', 114*c*'' is chosen to provide such lines with a characteristic impedance $Z_o$, here approximately equal to 100 ohms, with the parallel combination of such pair of lines here providing an impedance of approximately 50 ohms. The characteristic impedance of such transmission line formed from the strip conductors 114c', 114c'' is here related to the width of such lines w', the distance of such lines from the ground plane conductor 118 and the thickness and dielectric constant of the substrate. Since a void 118' is formed in the ground plane conductor 118, immediately underneath the strip conductors 114c', 114c'', a transmission line of a predetermined characteristic impedance is provided in part by means of fringe capacitance existing between the ground plane 118 and strip conductors 114c', 114c''. The size of the void 118' in the ground plane 118 is selected to insure that the strip conductor portions 114a, 114b provide, in combination with such ground plane 118 and dielectric 112, transmission lines having predetermined characteristic impedances as described above, and the size of the void 118' is also selected such that the ground plane 118 does not significantly interfere with coupling of r.f. energy as will be described. Further, the thickness of all strip conductors are chosen to minimize series resistance and inductance, as would be provided by a thin conductor.

The magnetically tuned resonant circuit 109 also includes a sphere 138 of a ferrimagnetic material, here yttrium iron garnet, and a second, here output, microstrip transmission line section 120 having a strip conductor portion 124 orthogonally spaced from strip conductor portion 114 of the first microstrip transmission line. The second microstrip transmission line also includes a dielectric substrate 122, here separating the second strip conductor 124 and a second ground plane conductor 128, as shown. Strip conductor 124 includes a first portion 124a of an arbitrary length and a second portion 124b. Strip conductor portions 124a and 124b are connected together by a pair of spaced strip conductor portions 124c', 124c'', as shown. Spaced, strip conductors 124c', 124c'' here provide a planar output r.f. coupling circuit 127. In a similar manner, as previously described, the length of portion 124b is chosen to provide in combination with a portion of strip conductors 124c', 124c'' to midpoints 127', 127'' thereof a length, l, substantially equal to one-quarter of a wavelength ($\lambda/4$). Further, end portion 124b has strip conductor segments 124b', 124b'' used to extend the length of the strip conductor portion 124b for lower frequency applications, as described above, and the strip conductor portion 124b is here terminated at the segment terminus thereof in an open circuit to provide at the midpoints 127', 127'' of strip conductors 124c', 124c'', a short circuit to resonant frequency r.f. energy. Provided between such split strip conductor portions $124_c'$, $124_c''$ of coupling circuit 127 is an aperture 126 through the dielectric substrate 122. The ground plane conductor 128 is formed on the surface of the dielectric substrate 122 opposite the strip conductor 124 to provide in combination therewith the microstrip transmission line section 120, as shown. A void 128' in the ground plane 128 is provided, exposing an underlying portion of the substrate 122. In the same manner as described above, the substrate thickness (h), dielectric constant thereof, and the strip conductor 124 width (w) are chosen to provide the microstrip transmission line section 120 with a predetermined characteristic impedance, here equal to 50 ohms. In a similar manner, the width of each planar strip conductor 124c', 124c'' is chosen to provide each one of such lines with a 100 ohm characteristic impedance, as previously described. In a preferred embodiment of the invention, microstrip transmission lines 110 and 120 are constructed to be identical in mechanical and electrical characteristics.

As shown more clearly in FIG. 12, the transmission line sections 110 and 120 are joined together to provide a composite transmission line body 130. The transmission lines 110 and 120 are arranged such that the corresponding apertures 116, 126 (FIG. 11) provided in the respective substrates 112, 122 are aligned to provide a common aperture 136 through the joined transmission line sections 110, 120. The transmission line sections 110 and 120 are further arranged such that strip conductor portions 114 and 124 thereof are spaced from one another by the separation provided by the substrates 112 and 122. That is, such microstrip transmission line sections 110, 120 are connected together along the surface of each one of the respective ground planes 118, 128 to provide a composite ground plane conductor 135, and the areas 118', 128' of the respective ground planes 118, 128 are aligned to form a void 135' in the composite ground plane conductor 135. The strip conductors 114 and 124 of each microstrip transmission line section are here orthogonally disposed with respect to each other, as shown for reasons to be described hereinafter. The sphere 138 of yttrium iron garnet (YIG), is then disposed in the aperture 136, as shown. The aperture 136 provided through the magnetically tuned resonant circuit 109 has a diameter equal to the diameter of the YIG sphere 138 disposed therein. At one end of the aperture 136 in the magnetically tuned resonant circuit 109 is inserted a button-shaped dielectric YIG sphere support 137 (FIG. 13) upon which the YIG sphere 138 may have been previously mounted. The sphere support 137 is disposed in the area between coupling circuit 127 and is used to support the YIG sphere 138 in the aperture 136. It is preferable that the YIG sphere 138 be positioned at the center of the magnetically tuned resonant circuit 109 such that the plane (not shown) of the ground plane 135 bisects the YIG sphere 138. Here the YIG sphere 138 has a diameter of 375 $\mu$m (0.015 inches). The metallization thickness for the ground plane 135 is 5 $\mu$m (0.0002 in.) and the thickness of the substrate is 375 $\mu$m. The diameter of the aperture 136 is thus 375 $\mu$m in order to permit the sphere 138 to be disposed therein. The YIG sphere 138 is preferably orientated prior to insertion within aperture 136 such that the external D.C. magnetic field $H_{DC}$, provided by disposing the composite body 130 between a magnetic pole piece 140a and a flux return yoke 140 (FIG. 13), is disposed with respect to a predetermined crystallographic direction of the YIG sphere 138, such that coupling of a resonance radian frequency energy $\omega_o$ (hereinafter resonant frequency) is independent of temperature. A preferred apparatus and method for orientating the YIG sphere 108 is described in conjunction with FIG. 43 to FIG. 45, although other methods for orientating a YIG sphere may be used. The first ends 114a, 124a of strip conductors 114, 124 are used to couple the magnetically tuned resonant circuit 109 to external components such as a system 160, as shown in FIG. 15. Selection of which one of the microstrip transmission lines 110, 120 is used as an input or output line is determined in accordance with its connection to the external components. As previously described, the length of each of such strip conductor portions 114b, 124b is chosen to have, in combination with a portion of the length of the coupling circuits 117, 127, a length l substantially equal to a quarter of a wavelength in order to provide, in combination with the open circuit termination of such lines, an effective r.f. short circuit at the midpoints 117', 127' of each coupling circuit 117, 127, as described above. As is known in the art, a short circuit is provided substantially at the midpoints 117', 127' of the coupling circuits 117, 127, respectively, in order to strongly couple the magnetic field component of the electromagnetic energy fed to the input microstrip transmission line section 110 through the YIG sphere 138 and to the output microwave transmission line section 120. A portion of the input energy having a frequency substantially equal to the resonant frequency $\omega_o$ of the YIG sphere 138 is coupled from the input microwave transmission line section 110 through the YIG sphere 138 to the output microwave transmission line section 120 in a manner to be described. Suffice it here to say that coupling of such microwave frequency energy having a frequency $\omega_i=\omega_o$ occurs within the region of such spaced strip conductor portions 114c', 114c'', 124c', 124c'', respectively.

Figure 21:
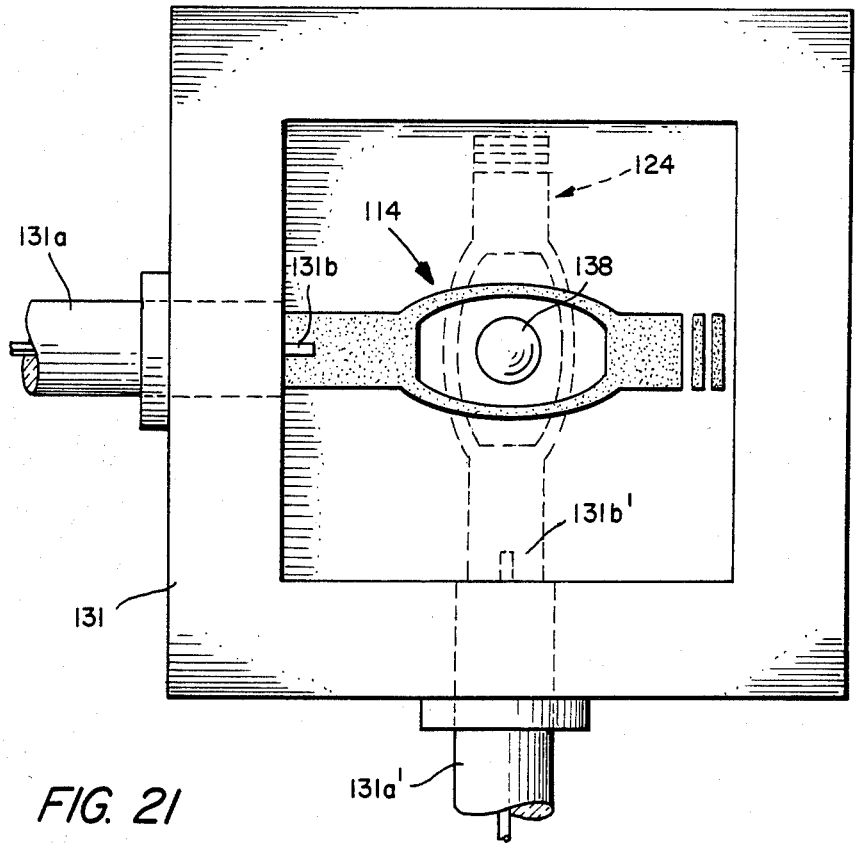
FIG. 21 is a plan view of the single stage magnetically tuned resonant circuit disposed in a housing.

As shown in FIGS. 13, 21 a housing 131 here of brass is provided to house the composite transmission line section 130. Such housing includes input and output coaxially connectors 131a–131a' (FIG. 21) and coaxial to microstrip launchers 131b–131b' to couple transmission lines 110, 120 to external circuit components.

Referring now to FIG. 15, a typical system 160 which includes the magnetically tuned resonant circuit 109, here a front end filter for a radio frequency receiver 168 is shown to include a first transmission line 164 connected between an antenna 162 and the input transmission line 110 of the magnetically tuned resonant circuit 109 and second transmission line 166 connected between the output transmission line section 120 of the magnetically tuned resonant circuit 109 and the receiver 168. In operation, a radio frequency signal received by the antenna element 162 is fed to the input transmission line 110 of the magnetically tuned resonant circuit 109, via transmission line 164. In accordance with the equation $\omega_i=\omega_o$, a portion of the microwave signal fed to the input transmission line section 110 is coupled to the output transmission line section 120 of the magnetically tuned resonant circuit 109 in a manner now to be described. This coupled signal (not shown) is then fed to the receiver 168.

Referring now to FIG. 13 and FIG. 14, a D.C. magnetic field $H_{DC}$ (FIG. 12) is shown with flux lines thereof normal to the plane of the ground plane conductor 135 of the magnetically tuned resonant circuit 109. The DC magnetic field $H_{DC}$ is here generated by placing the magnetically tuned resonant circuit 109 between the pole piece 140a and flux return yoke 140 (FIG. 13), as shown. In the presence of such a DC magnetic field $H_{DC}$ applied along a Z axis, for example, an input signal is fed to input transmission line 110 (FIG. 11) and the signal passes through the spaced, split or bifurcated strip conductor portions 114c', 114c'' of input coupling circuit 117 disposed along an X axis, for example, producing an r.f. magnetic field $H_{rf}$(FIG. 14) in the vicinity of strip conductor 114c', 114c'', as shown. In the absence of the YIG sphere 138 there is no coupling of the energy fed through the microstrip transmission section 110 to the output microwave transmission line 120 since the input coupling circuit 117 is orthogonally orientated with respect to the output coupling circuit 127. Thus, such energy is reflected back towards the input source, here the antenna 162. With a YIG sphere disposed in aperture 136, spaced a distance d along a Z direction thereof, a portion of the energy fed on the input coupling circuit 117 is transferred to the YIG sphere 138. The YIG sphere is positioned along a direction where the X component of r.f. magnetic field $H_x$ has a maximum value. Further, due to the symmetric structure of the input coupling circuit 117, as shown in FIG. 17, the resultant magnetic field coupling component $H_x$ is relatively uniform through the YIG sphere 138. In the general case, thus, the number of such strip conductors, their shape, and alignment with respect to the YIG sphere 138, are selected to provide through the YIG sphere volume a predetermined magnetic field distribution from a signal fed to such strip conductors. That is, the current fed to such strip conductors is selectively channeled or distributed among the various conductors to provide a predetermined distribution of the magnetic field generated in response to such current. Generally, in order to reduce coupling to higher order resonance modes, the field distribution through a spheroid shaped ferrimagnetic body is chosen to be uniform. Other field distributions in combination with differently shaped ferrimagnetic bodies can be provided to insure that higher order resonance is suppressed. Suppression of higher order resonance is further described in conjunction with FIGS. 17, 17A.

The frequency of the energy transferred to the spins of the electrons in the YIG sphere 138 is related to $\omega_o=\gamma H_{DC}$ where $\gamma$ is the quantity referred to as the "gyromagnetic ratio" as previously defined. Nonresonant frequency energy not transferred to the YIG sphere 138 is reflected backward toward the input source, here the antenna 162. Energy transfer between the input microwave transmission line section 110 and the YIG sphere 138 thus is possible when the frequency ($\omega_i$) of the r.f. signal fed thereto is equal to the natural precession frequency $_o$ of the YIG sphere 138 as defined by the equation $\omega_o=\gamma H_{DC}$. When this resonant condition is satisfied ($\omega_i=\omega_o$), the magnetic field component $H_x$ of the input energy fed to the input coupling circuit 117 having a frequency near the resonant frequency ($\omega_o$) is transferred to the spins of the electrons in the YIG sphere 138 by making the electrons precess about their Z axis. Precession of electrons about their Z axis produces in response thereto a magnetic moment about the Y axis, enabling coupling of r.f. energy to output transmission line section 120 which is disposed about the Y axis by inducing a voltage in output coupling circuit 127 and providing a current flow therein. The frequency of such a coupled signal in the Y axis circuit is $\omega_o$, as is well-known in the art. Further, there is also transfer of energy having a frequency which deviates from $\omega_o$, the resonant frequency. The strength of coupling of energy having a frequency which deviates from $\omega_o$ and hence the bandwidth of the coupling thereof is determined by the proximity of such frequency to $\omega_o$, the resonant frequency and impedance $Z_{110}$, $Z_{120}$ of the transmission lines 110, 120 as previously described.

A YIG filter providing a passband of $f_o=20$ MHz at a center frequency of $f_o=10$ MHz where $f_o=\omega_o/2\pi$, tunable over at least 500 MHz band in the X-band range and having an insertion loss at $f_o$ less than 1.3 db, has the following properties:

| Symbol | Description | Value |
|---|---|---|
| w | width of strip conductor 114a, 124c | 15 mil |
| w' | width of strip conductor 114c', 114c' | 3 mil |

-continued

| Symbol | Description | Value |
|---|---|---|
| | 124c', 124c' | 3 mil |
| $w_s$ | width of stubs 114b, 124b | 30 mil |
| | substrate material | alumina |
| h | substrate thickness | 15 mil |
| | aperture diameter | 15 mil |
| k | dielectric constant of substrates 112, 122 | 9.3 |
| D | diameter of void | 60 mil |
| d | separation of coupling circuit conductors 114c', 114c", 124c', 124c" | 35 mil |
| c | length of coupling circuit | 60 mil |

Referring now to FIG. 16, the effect of the ground plane conductor 135 of the magnetically tuned resonant circuit 109 on transfer of energy between input and output transmission lines 110, 120 through the YIG sphere 138 will be described. As is known in the art, when a sphere resonator is in close proximity to a conductive wall, such as the coupling loops or the filter r.f. housing of the "wire loop type YIG filter", two principal effects which occur are: a frequency shift in the resonant frequency ($\omega_o$) and a "line broadening" effect. "Line broadening" is a term in the art which refers to an increase in the frequency band which will resonate with the YIG sphere 138, albeit at a reduced efficiency, thereby increasing the resonant frequency insertion loss of the YIG sphere 138.

In most prior art structures (not shown) the YIG sphere 138 is located close to a conductive wall such as the coupling loop or the filter's r.f. housing. In such cases, a frequency shift results from the proximity of the sphere to the conductive wall because the r.f. magnetic field (not shown) associated with the precessing magnetization of electrons in the sphere (the vector sum of the precessing magnetization of all the electrons in the sphere) is distorted in the vicinity of the surface of the conductive wall due to the conductivity thereof. This distortion of the r.f. magnetic field produces a shift in resonant frequency of the resonant circuit. This shift is partially compensated for in the prior art structure by changing the applied D.C. field. However, the frequency shift is also a function of temperature making temperature independant operation more difficult to achieve. With the present invention, as diagrammatically shown in FIG. 16, the YIG sphere 138 is disposed midway through the aperture 136. That is, the YIG sphere 138 is symmetrically disposed through the void 135' in the ground plane conductor 135. Since, under resonant conditions, the precessing magnetization M in the uniform resonance mode is provided in the Y direction, it is already parallel to the ground plane 138 and hence there is no significant distortion of the magnetic field and thus no significant frequency shift caused by the ground plane conductor 138.

The second effect provided by close proximity of a sphere resonator to a conductive surface is the so-called "line broadening" effect which results from eddy currents flowing in the conductive wall. The eddy currents result from voltages being induced in the conductive wall due to the varying r.f. magnetic field. In the prior art structures mentioned above, the eddy currents and hence the line broadening effect are reduced by positioning the spheres at a greater distance from the conductive wall since the power dissipated due to the "line broadening" effect is proportional to $1/d^4$ where d is the distance between the conductive wall and the center of the sphere. However, often this approach reduces the coupling between input and output lines and thereby degrades performance. In the present structure, this problem is substantially eliminated because, as shown in FIG. 16, the ground plane conductor 135 bisects the YIG sphere 138. Since a portion of the ground plane conductor 135 can be selectively removed in the area adjacent the YIG sphere 138 providing the void 135', as previously described, eddy current losses can be minimized. That is, since eddy current loss is related to the distance d between the YIG sphere 138 and the conductive surface, here the ground plane conductor 135, the diameter of the void 135' through the ground plane conductor 135 can be made sufficiently large without any significant reduction in resonant coupling strength, thereby reducing eddy currents in such ground plane and hence reducing the "line broadening effect" and resonant frequency insertion loss.

Referring now to FIG. 17, an idealized graph of the strength of the coupling component $H_{rfx}$ (in free space) of the r.f. magnetic field $H_{rf}$ in the X direction is shown as a function of the vertical distance (i.e. along the axis) between the YIG sphere 138 and a pair of conductors which approximate the input coupling circuit 110 for the magnetically tuned resonant circuit 109 (curve 1) in comparison with an idealized graph of the coupling component $H_{rfx}$ as a function of the vertical distance between a single conductor and a YIG sphere, which approximate a single conductor prior art structure (curve 2). The spatial relationship between the conductors 114, 124 (FIG. 12) and the YIG sphere 138 and a typical prior art structure are diagrammatically shown in FIG. 17. The magnetic field generated by a pair of conductors (in free space) in the region where the YIG sphere 138 is disposed (curve 1) is relatively uniform throughout the YIG sphere 138 in comparison to the magnetic field generated by a single wire (curve 2) that traverses such region. As is known in the art, YIG spheres when used in microwave bandpass filters, for example, due to excitation of nonuniform modes of resonance in the YIG sphere, will transfer spurious energy signals here shown as peaks 152a', 152b' in FIG. 17A (Case 2) having a frequency outside the passband 152' of the filter, as shown. The transfer of this spurious energy is generally undesirable. The spurious energy is transferred by exciting higher order modes of ferrimagnetic resonance generally referred to as "magnetostatic modes of resonance." These modes of resonance occur when the YIG sphere in the presence of the D.C. magnetic field $H_{DC}$ is positioned where there is a spatial variation of the r.f. magnetic field through the volume of the YIG sphere 138 such as that shown in FIG. 17 for curve 2. It is theorized here that, as a result of this spatial variation of the field across the YIG sphere 138, the electrons in the upper half of the sphere oscillate in phase opposition to the electrons in the lower half of the sphere, thus providing phase and amplitude variations of the resonant energy across the YIG sphere. One of the advantages of the present invention is the relative uniformity of the r.f. magnetic field which is provided through the YIG sphere 138, as was described in conjunction with FIG. 17 (curve 1). The present invention provides a reduced excitation of magnetostatic modes of precession and thus reduced spurious energy transfer (peaks 152a, 152b), as shown in FIG. 17A, case 1, since the magnetic field through the sphere 138 is in general more uniform.

The orientation of the ground plane conductor 135 with respect to the sphere 138 provides an additional advantage over the above-mentioned prior art structures. As previously described, there is no frequency shift since the r.f magnetic field associated with the uniform mode of precession is a priori provided in a plane parallel to the ground plane 135 without any distortion in the r.f. magnetic field. For most nonuniform modes, however, the r.f. magnetic field associated with the precessing magnetization thereof has components perpendicular to the ground plane conductor 135. Thus, the resonant frequency of such modes in the presence of a conductive wall is shifted relative to the resonant frequency of the same mode in the absence of a metal wall. Further, in the ground plane will be induced eddy currents from the magnetostatic resonant energy which will further decrease the strength of spurious energy transmission due to the line broadening effects described earlier. In other words, the coupling circuits 117, 127 provide a relatively uniform r.f. excitation of the YIG sphere 138, resulting in reduced magnetostatic resonance and hence lower spurious energy transfer. At the same time, due to the line broadening effect on the magnetostatic resonant frequency, the coupling circuits 117, 127 provide a significant insertion loss to any nonuniform resonant energy transferred, further reducing spurious responses.

Figure 18:
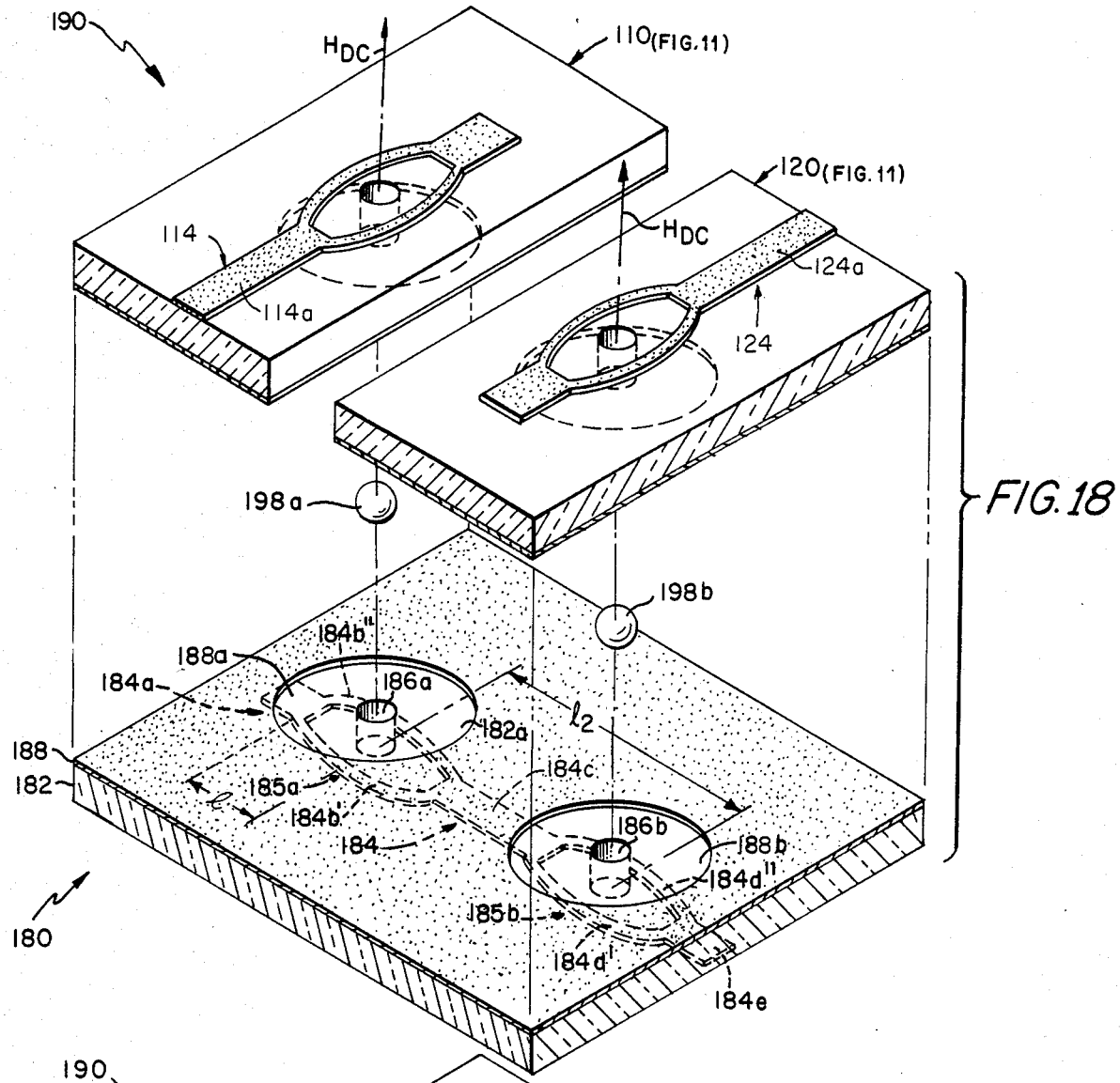
FIG. 18 is an exploded isometric view of a dual-stage magnetically tuned resonant circuit having coupling circuits for selectively shaping the r.f. magnetic field in the region adjacent a resonant body.
Figure 19:
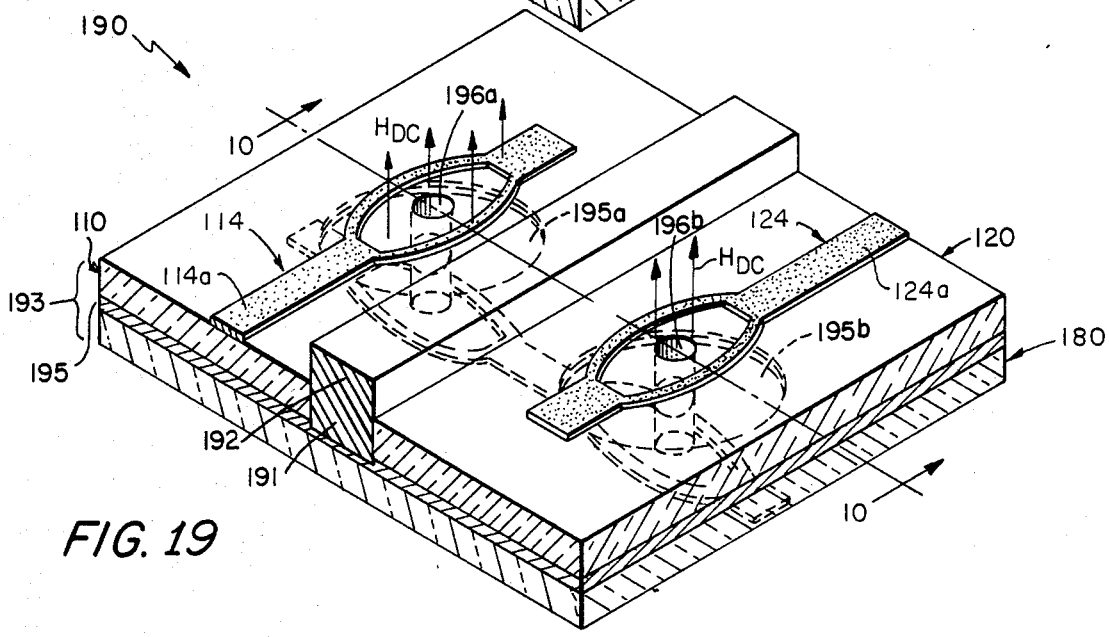
FIG. 19 is an isometric view of the dual-stage magnetically tuned resonant circuit shown in FIG. 18.
Figure 20:
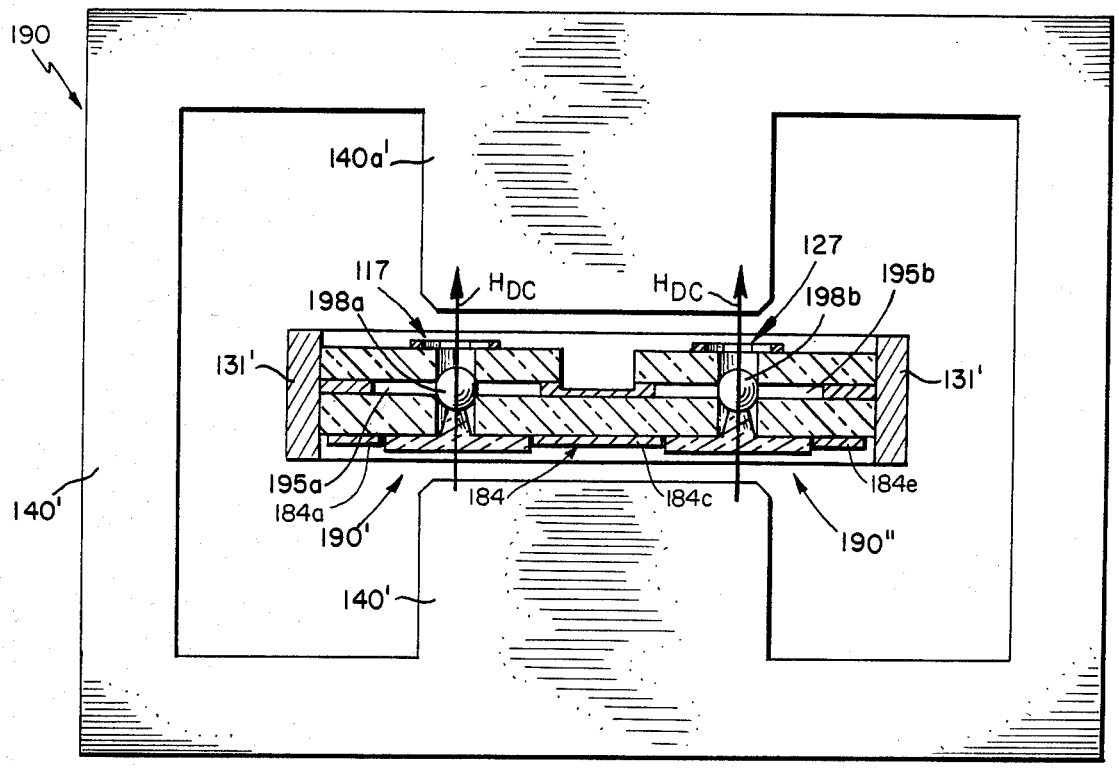
FIG. 20 is a cross-sectional view of FIG. 19 taken along lines 20—20 wherein the circuit is disposed between a magnetic pole piece and a flux return yoke.

Referring now to FIGS. 18–20, a two stage magnetically tuned resonant circuit 190 fabricated according to the teachings of the present invention is shown. Referring first to FIG. 18, the magnetically tuned resonant circuit 190 is shown to include a first input transmission line section 110, here substantially identical to the input transmission line section 110 described in conjunction with FIG. 11, a first output transmission line section 120 substantially identical to the output transmission line section 120 described in conjunction with FIG. 11, an interstage transmission line section 180, and YIG spheres 198*a*, 198*b*, as shown. Interstage transmission line section 180 here includes a dielectric substrate 182 separating a strip conductor 184 and a ground plane conductor 188, as shown. The strip conductor 184 is provided substantially across the entire length of the substrate 182 (having a length, $l_1$, equal to $(2n+1)\lambda/4$ wavelengths (where $(2n+1)$ is an odd multiple multiplier, n is an integer) and includes a pair of quarter wavelength stubs 184*a*, 184*e*, two pairs of spaced or bifurcated strip conductor segments 84*b*′, 184*b*″, and 184*d*′, 184*d*″ providing interstage coupling circuits 185*a*, 185*b* and a strip conductor 184*c* coupling together such segments 184*b*′, 184*b*″ and 184*d*′, 184*d*″, as shown. Stub portions 184*a*, 184*e* have a length, l, in combination with a portion of the coupling circuits 185*a*, 185*b* to provide a quarter wavelength stub as previously described in conjunction with FIGS. 11–13. Provided in the substrate 182 between each pair of such split strip conductors 184*b*′, 184*b*″ and 184*d*′, 184*d*″ is a corresponding aperture 186*a*, 186*b*, respectively, through such substrate 182 and ground plane conductor 188, as shown. A pair of circular voids 188*a*, 188*b* are formed in the ground plane conductor 188 in the area adjacent such apertures 186*a*, 186*b* exposing portions of the substrate 182 and the apertures 186*a*, 186*b* therein, as described in conjunction with FIG. 11. The distance $l_2$ between the centers of such apertures 186*a*, 186*b* is an odd multiple $(2n+1)$ of a quarter wavelength $\lambda/4$ where n is an integer. The length, $l_1$ of the strip conductor 184 and the distance $l_2$ between the apertures 186*a*, 186*b* are chosen to be an odd multiple of a quarter wavelength in order to preserve the r.f. short circuits at the center of each aperture 186*a*, 186*b*, as previously described, and to maintain a uniform balance of electrical characteristics across such strip conductor 184. Further, the impedance here approximately 50 ohms is shown to provide desired coupling between the stages.

As shown more clearly in FIGS. 19, 20, the input transmission line section 110, the output transmission line section 120, and the interstage transmission line section 180 are joined together to provide a composite transmission line body 193. The transmission line sections 110, 120 and 180 are joined together providing a composite ground plane 195. A channel 191 is obtained between such microwave transmission line sections 110, 120 when such sections 110, 120 are joined with the interstage transmission line section 180. A suitable housing 131′ (FIG. 20) similar to the housing 131 shown in FIG. 21 for the single stage circuit 109) is provided to hold such transmission line sections 110, 120, 180 together. A conductive slab 192 is provided in the channel 191 between such transmission line sections 110, 120. Conductive slab 192 here provides a conductive path to the ground plane 195 between input transmission line section 110 and output transmission line section 120 to prevent direct coupling of signals therebetween. A pair of apertures 196*a*, 196*b* through the dual stage magnetically tuned resonator 190 are provided from apertures 116, 186*a* and 126, 186*b*, as previously described in conjunction with FIG. 12, for aperture 136. Each aperture has associated therewith a void 195*a*, 195*b* in the ground plane 195 as previously described in conjunction with FIG. 12. As shown in FIG. 20, a first stage 190′ of the dual stage magnetically tuned resonant circuit 190 is shown to include a YIG sphere 198*a* disposed in aperture 196*a*, and a second stage 190″ of the resonant circuit 190 is shown to include a YIG sphere 198*b* disposed in aperture 196*b*.

Coupling of a portion of an r.f. signal fed to the strip conductor 114 of input transmission line 110 to the strip conductor 124 of output transmission line 120 will now be described. As shown, the external D.C. magnetic field $H_{DC}$ is here applied normal to the surface of the composite body 193. The DC magnetic field $H_{DC}$ is generated, as previously described, by placing the magnetically tuned resonant circuit between a magnetic pole piece here 140*a*′ and a flux return yoke 140′ (FIG. 20). Radio frequency energy in the presence of the DC magnetic field $H_{DC}$ is fed to strip conductor 114 at portion 114*a* thereof of the first stage 190′. In accordance with the equation $\omega_o=\gamma H_{DC}$, the portion of such input energy having a frequency substantially equal to $\omega_o$ is transferred to the spins of the electrons in YIG sphere 198*a*, disposed in aperture 196*a* , in a similar manner as previously described in conjunction with FIG. 7, by making the electron spins thereof precess about the direction of the external field $H_{DC}$, here the Z axis. In a like manner, as previously described in conjunction with FIG. 19, the precession of electrons about the Z axis produces an R.F. magnetic moment in the Y direction, enabling coupling of such energy to the first pair of split strip conductors 184*b*′, 184*b* ″ of the interstage strip conductor 184. Such coupled energy is then fed along the intermediate strip conductor 184*c* to the second pair of split strip conductors 184*d*′, 184*d*″. In a similar manner, as described above, substantially all of the energy fed to split strip conductors 184*d*', 184*d*'' is transferred to the spins of the electrons in the YIG sphere 198*b* and, in a similar manner as described above, such energy is then coupled to the strip conductor 124 and fed to the output portion 124*a* thereof. Suppression of magnetostatic resonance modes, line broadening and frequency shift effects as described in conjunction with FIGS. 16–17, 17A for the single stage magnetically tuned resonant circuit 130 in a like manner applies the dual-stage magnetically tuned resonant circuit 190. Since in each single stage 190', 190'' of the dual-stage magnetically tuned resonant circuit 190 the magnetostatic resonance modes are suppressed, the dual-stage filter may be designed using two pure crystal YIG spheres. Further, the dual resonator 190 will have lower insertion loss and enhanced temperature performance due to reduction or elimination of line broadening and frequency shift effects, as described above for the magnetically tuned resonator 130.

Alternatively, the coupling circuits shown in FIGS. 11–13 and 18–20 may be provided by a pair of conductive wires coupling such portions of the strip conductors together, or by a pair of, straight lengths of conductive wires or strip conductors formed on the substrate or by four conductors properly disposed for providing a predetermined magnetic field distribution. In addition, such coupling circuits may be directly terminated to ground through a hole drilled or bored through the substrates and connected with the ground plane to provide electrical contact. Further, the coupling structure and the mechanical configuration of the magnetically tuned resonant circuit disclosed herein may be used with other types of magnetically tuned resonant circuits such as oscillators and the like.

Figure 22:
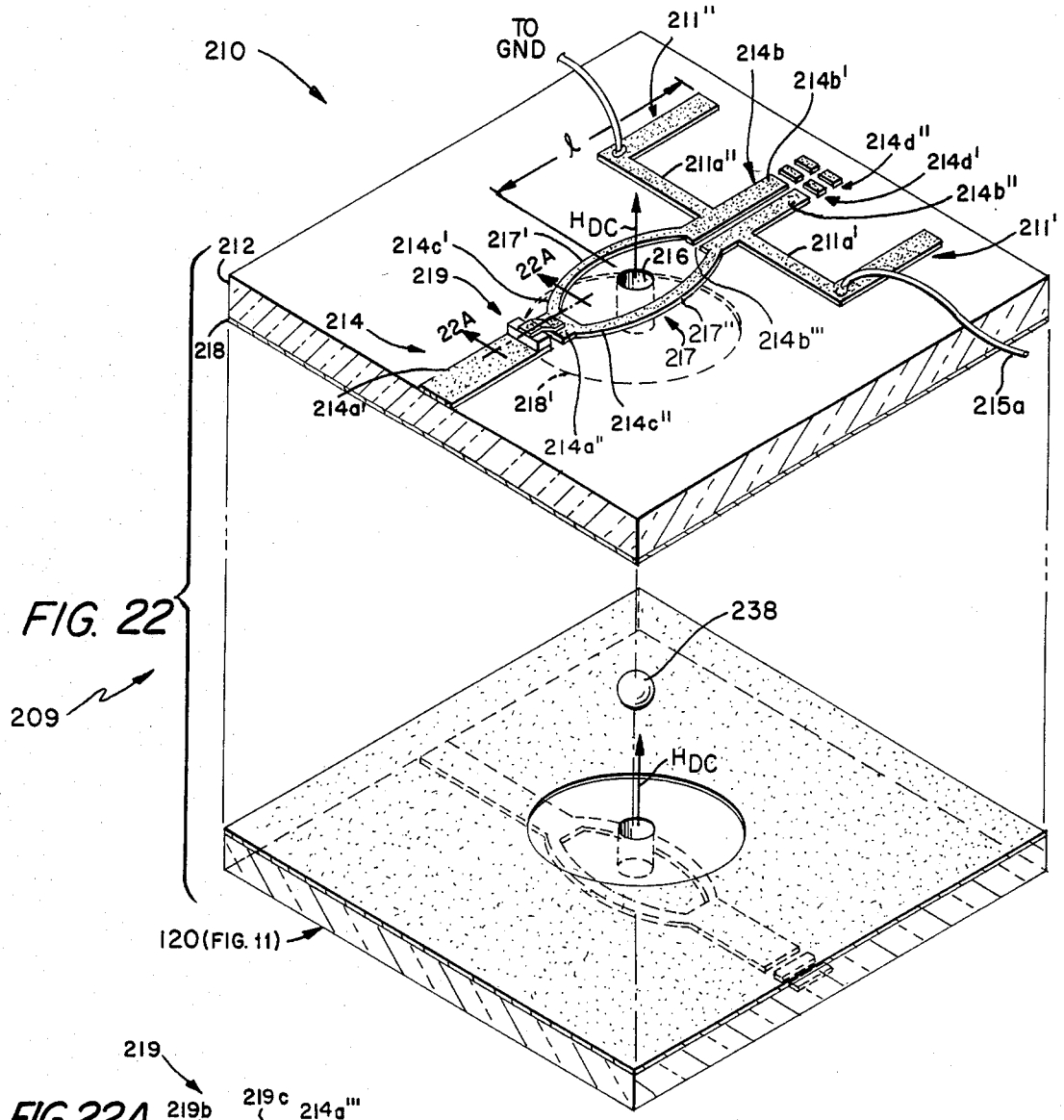
FIG. 22 is an exploded isometric view of a magnetically tuned resonant circuit having a pulse field coil.
Figure 23:
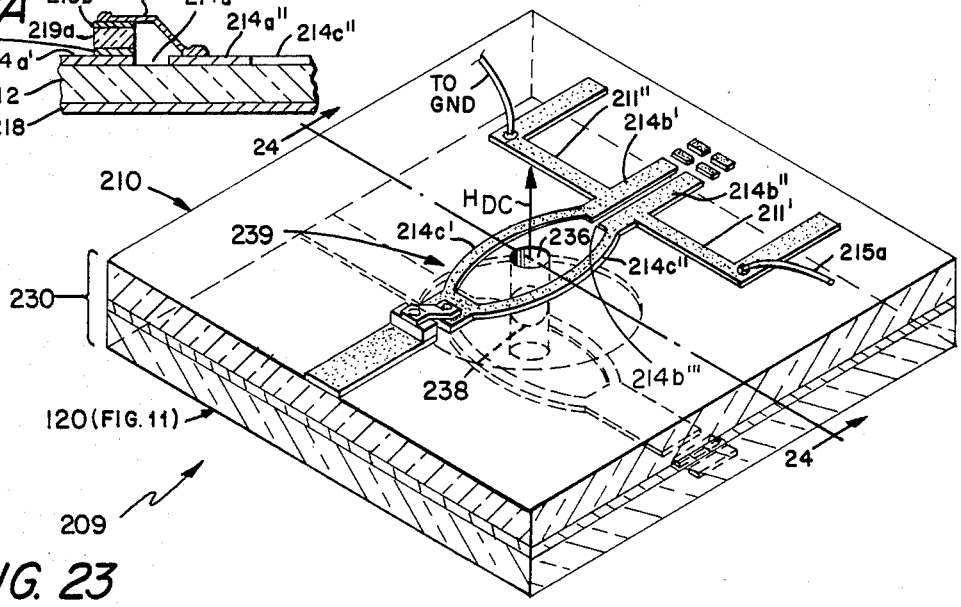
FIG. 23 is an isometric view of the magnetically tuned resonant circuit having a pulse field coil shown in FIG. 22.
Figure 24:
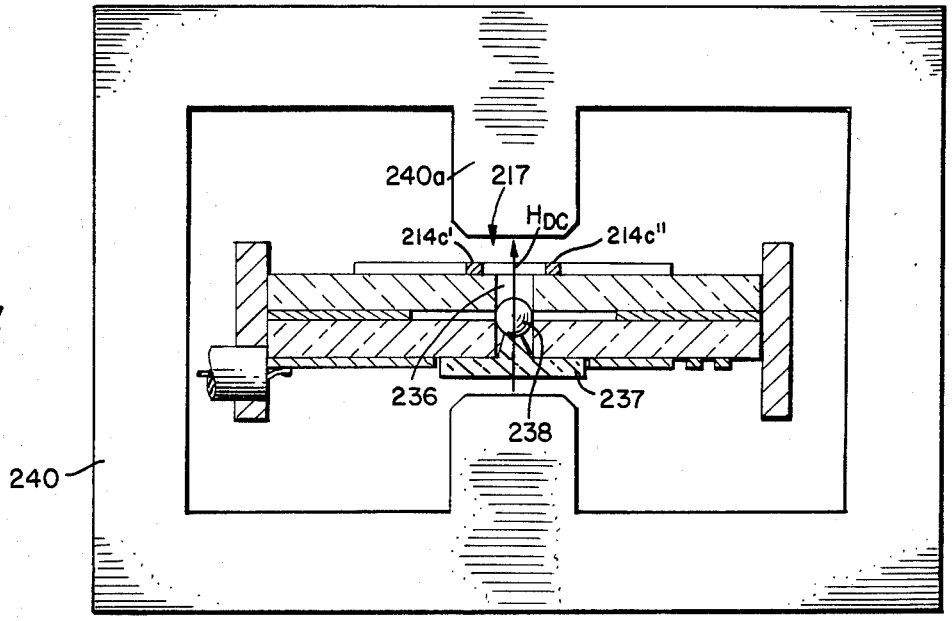
FIG. 24 is a cross-sectional view of FIG. 23 taken along lines 24—24 wherein the circuit is disposed between a magnetic pole piece and a flux return yoke.

Referring now to FIGS. 22–24, fabrication of a magnetically tuned resonant circuit 209, here a bandpass filter, having a pulse field coil integrally formed therewith in accordance with the teachings of the present invention will be described. Referring first to FIG. 22, a first, here input, microstrip transmission line section 210 is shown to include a dielectric substrate 212 separating a ground plane conductor 218 and a strip conductor 214. The strip conductor 214 has a first portion 214*a* of an arbitrary length and a second portion 214*b*. Strip conductor portion 214*a* is split lengthwise providing portions 214*a*', 214*a*'' thereof with a channel 214*a*''' therebetween, as shown. Strip conductor portions 214*a*' and 214*a*'' are electrically connected together by a low frequency blocking capacitor 219.

Figure 22A:
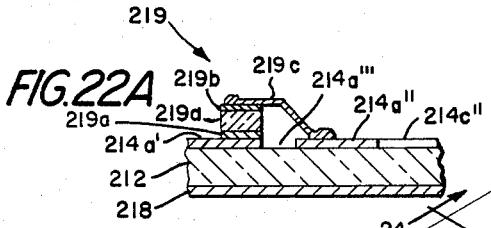
FIG. 22A is a cross-sectional view of a portion of FIG. 22.

As shown in FIG. 22A, blocking capacitor 219 has a first conductive plate 219*a* connected to portion 214*a*' and a second conductive plate 219*b* connected to portion 214*a*'', via a conductive interconnect 219*c* which bridges the channel 214*a*'''. The plates 219*a*, 219*b* are spaced apart by a dielectric slab 219*d*. The value of capacitance for capacitor 219 is chosen to provide a very low impedance to radio frequency electromagnetic energy and a relatively high impedance to lower frequency electromagnetic energy, to isolate such energy from the input portion 214*a*' of the strip conductor 214.

As further shown in FIG. 22, the strip conductor 214 includes a second strip conductor portion 214*b*. Strip conductor portions 214*a*'' and 214*b* are connected together by a pair of spaced strip conductors 214*c*', 214*c*'', here providing a planar input r.f. coupling circuit 217. The length of strip conductor portion 214*b* is chosen to provide, in combination with a portion of the length of strip conductors 214*c*', 214*c*'' to midpoints 217', 217'' of the coupling circuit, a length, l, substantially equal to one quarter of a wavelength (λ/4). Further, portion 214*b* of strip conductor 214 has a plurality of strip conductor segments 214*d*', 214*d*'' formed adjacent thereto, used to extend the length of the strip conductor portion 214*b* for lower frequency applications and hence longer wavelengths by selectively bonding one or more of such segments to the strip conductor portion 214*b*. Strip conductor portion 214*b* is here terminated in an open circuit at the segment end thereof, to provide at the midpoints 217', 217'' of the coupling circuit 217, a short circuit to such r.f. energy, as previously described in conjunction with FIG. 11. Further, the impedance of a stub 219 (such stub 219 being formed from the strip conductor 214*b*, the dielectric 212 and ground plane 218) is selected to provide the resonant circuit with the desired bandwidth, as previously described in conjunction with FIG. 11 for stub 119.

Figure 38:
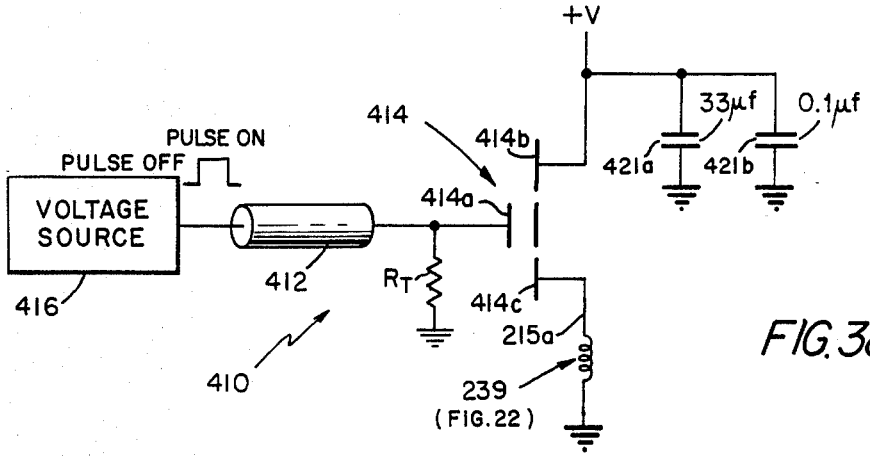
FIG. 38 is a schematic diagram of a drive circuit used to produce a pulse of current to drive the pulse field coil.

Portion 214*b* and segments 214*d*', 214*d*'' thereof are split or etched lengthwise, to provide strip conductor portion 214*b* a first bifurcated portion 214*b*' and a second bifurcated portion 214*b*'' spaced by a channel 214*b*''', as shown. The width of such channel is selected to provide isolation between such conductor portions 214*b*', 214*b*'' for low frequency signals but to provide effectively a single conductor 214*b* due to fringe capacitance between such conductor portions 214*b*', 214*b*'' for radio frequency signals. The microstrip transmission line section 210 further includes a first center tapped half wavelength (λ/2) strip conductor stub 211' integrally formed at a first end with the bifurcated portion 214*b*', and terminated in an open circuit at a second end. The center of such stub 211' is connected to an input current feed line 215*a*. A second λ2 center tapped strip conductor stub 211'' is shown integrally formed at a first end with the split portion 214*b*'' and terminated at a second end in an open circuit (O). The center of the stub 211'' provides a second terminal to provide a return flow path for the signal fed to current feed line 215*a*. Strip conductor stubs 211', 211'' are here provided to block flow of r.f. energy through a current pulse source (FIG. 38). Each stub 211', 211'', as previously described, is provided with a length equal to λ/2. As previously described, an open circuit at a first end of a transmission line will provide at a second end thereof, an effective r.f. short circuit, if the distance separating such ends is a quarter of a wavelength, for signals having a quarter wavelength substantially equal to the length of such transmission lines. Similarily, an effective r.f. short circuit at a first end of a transmission line will provide at a second end thereof an effective r.f. open circuit, if the distance separating such ends is a quarter of a wavelength. Here by providing an open circuit at the ends of each stub 211', 211'' respectively, an effective r.f. short circuit is provided at the center taps of each stub, and thus at the ends connected to split conductors 214*b*', 214*b*'' an effective r.f. open circuit (o) is provided since one quarter of a wavelength therefrom at each center tap there is an effective r.f. short circuit. Thus, the stubs 211', 211'' isolate r.f. energy fed to strip conductor 214*b*, by providing open circuits to such r.f. energy while feeding a current pulse to the coupling circuit 217 to produce a magnetic field in response thereto, in a manner to be described.

Provided through the substrate 212 and ground plane conductor 218 between the planar, spaced strip conductor portions 214*c*', 214*c*'' is an aperture 216. The ground plane conductor 218 is formed on the surface of the dielectric substrate 212 opposite the strip conductor 214 to provide in combination with such strip conductor 214 and dielectric substrate 212 the microstrip transmission line section 210, as shown. A void 218' is formed in the ground plane 218 using conventional masking and etching techniques, exposing a portion of the underlying substrate 212. The void 218' in the ground plane 218 is concentrically spaced about the aperture 216 and exposes portions of the substrate 212 extended beyond the periphery of the strip conductors 214c', 214c''. As previously described, the width (w) of the strip conductor 214, and the thickness (h) and dielectric constant of the substrate 212 are chosen to provide in combination with the ground plane 218 the microstrip transmission line section 210 with a predetermined characteristic impedance $Z_o$, here equal to 50 ohms and the width w' of planar spaced conductors 214c', 214c'' is chosen to provide such lines with a characteristic impedance $Z_o$, here approximately equal to 100 ohms, with parallel combination of such lines here providing an impedance of approximately 50 ohms. The thickness of each one of such conductors 214c', 214c'' is chosen to minimize series resistance and inductance, as would be provided by a thin conductor.

The magnetically tuned resonant circuit 209 also includes the second, here output, microstrip transmission line section 120 as was previously described in conjunction with FIG. 11, and a YIG sphere 238.

As shown more clearly in FIG. 23, the microstrip transmission line section 210 and the microstrip transmission line section 120 are joined together to provide a composite transmission line body 230. A single turn pulse field coil 239 for changing the strength of the D.C. magnetic field in the area adjacent the YIG sphere 238, is here provided by the λ/4 portion 211a' of stub 211' connected to conductor portion 214b', the planar spaced conductors 214c', 214c'', the conductor portion 214b'' and the λ/4 portion 211a'' of stub 211'' connected to conductor portion 214b''. The strength of the field is changed in a manner to be described in conjunction with FIGS. 24–25. It is to be noted that the transmission line sections 210 and 120 are arranged in a manner as described in conjunction with FIGS. 24 to 25.

Figure 39:
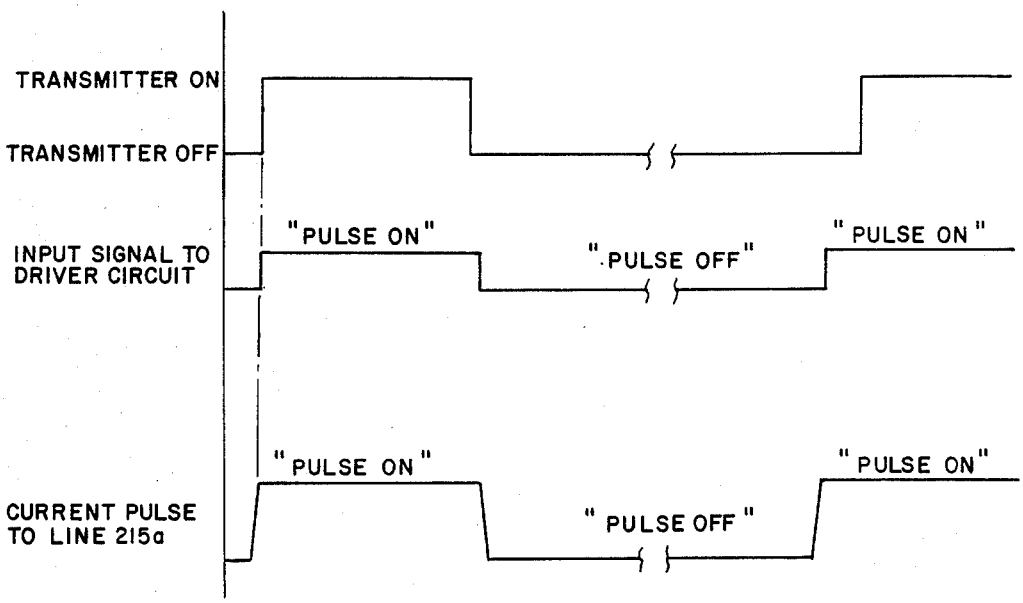
FIG. 39 is a graphic depicting typical timing relationship used in a typical application of the invention such as the system shown in FIG. 26.

Referring now to FIGS. 38, 39, a driver circuit 410 (FIG. 38) for providing, in response to a control signal "pulse on" (FIG. 39), a pulse signal to current feed line 215a will be described. Driver circuit 410 here includes a transmission line 412 connected between a voltage source 416 and a switching element 414, here connected to the gate electrode 414a of a field effect transistor (FET). (Here a "HEXFET" manufactured by International Rectifier Part Number IRF 221 is used). Shunt mounted between ground and the gate electrode 414a is a termination resistor $R_T$ provided to match the impedance of the transmission line 412 to that of the input impedance of the FET 414. The drain electrode 414b of FET 414 is connected to a power source +V, filter capacitors 421a, 421b to provide the current pulse, and the source 414c electrode is connected to the current feed line 215a, as shown. In response to the "pulse on" signal, a voltage level of here +10.0 volts is applied to the gate electrode 414 to turn the FET 414a "on" and to permit current to flow from the power supply V+, the current feed line 215a and through the coil 239 to ground, as shown in FIG. 38. A voltage level of here zero volts is applied to turn the driver circuit off.

Figure 26:
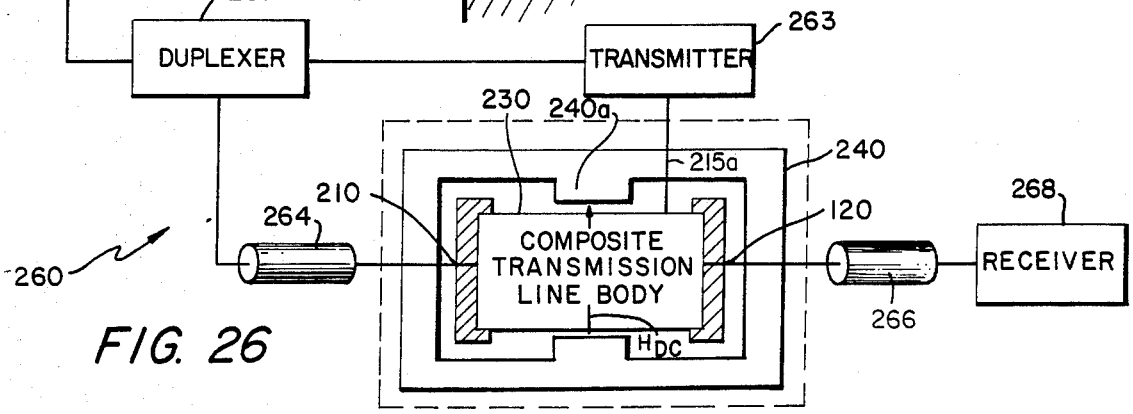
FIG. 26 is a block diagram of a typical application for a magnetically tuned resonant circuit having a pulse field coil, such as that shown in FIG. 23.

Referring now to FIG. 26, a typical application 260 of the magnetically tuned resonant circuit 209, here a front end filter for a radio frequency receiver 268 is shown to include a first transmission line 264 connected between a duplexer 261 and the input transmission line 210 of the magnetically tuned resonant circuit 209 and second transmission line 266 connected between the output transmission line section 120 of the magnetically tuned resonant circuit 209 and the receiver 268. The duplexer 261, here an r.f. switch is also connected to a transmitter 263 and an antenna 262. In operation, the transmitter 263 sends out a very high power pulse of microwave energy at the resonant frequency $\omega_o$. The duplexer 261 switches the signal such that most of the energy of the transmitted signal is fed to the antenna 262. However, a portion of the signal leaks through the duplexer to the received path. In a first mode of the operation, the resonant frequency of such circuit 209 is shifted by changing the magnitude of the DC magnetic field $H_{DC}$ in a manner to be described and such energy is prevented from coupling through the resonant circuit 209 to the receiver 268. After a high power signal transmission and prior to reception of an echo signal, the transmitter switches the duplexer 261 to connect the antenna 262 to the receiver 268, and the echo signal is fed to the receiver 268 through the magnetically tuned resonant circuit 209 in a manner to be described.

Figure 25:
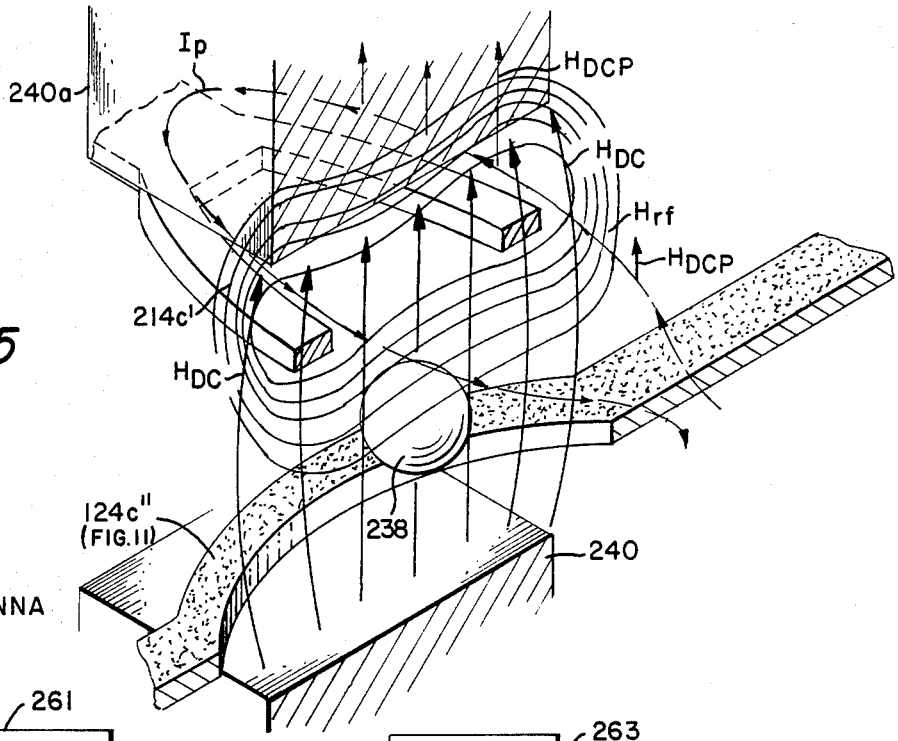
FIG. 25 is a diagrammatic view of FIG. 24 graphically showing the relationship of the r.f. magnetic field, the D.C. magnetic fields and the resonant body.

Referring now to FIG. 24 and FIG. 25, the magnetically tuned resonant circuit 209 is shown in the presence of the D.C. magnetic field $H_{DC}$ with flux lines thereof normal to the ground plane 235 of the magnetically tuned resonant circuit 209. The DC magnetic field $H_{DC}$ is here generated by placing the magnetically tuned resonant circuit 230 between a magnetic pole piece 240a and a flux return yoke 240 (FIG. 24), as shown. In the presence of such a field $H_{DC}$ applied along a Z axis, for example, an input signal is fed to input transmission line 210 (FIG. 22) and the signal passes through the split strip conductor portions 214c', 214c'' of input coupling circuit 217 disposed along an X axis, for example, producing an r.f. magnetic field $H_{rf}$(FIG. 25) in the vicinity of strip conductor 214c', 214c'', as shown. Without the YIG sphere 238 disposed in aperture 236, there is no coupling of the energy fed through the microstrip transmission section 210 to the output microwave transmission line 120 as previously described in conjunction with FIGS. 11 to 13. With a YIG sphere disposed in aperture 236, a portion of the energy fed on the input coupling circuit 217 is absorbed by the YIG sphere 238 as previously described in conjunction with FIGS. 11 to 13. In the general case, thus, the number of such strip conductors, their shape, and alignment with respect to the YIG sphere 238, are selected to provide through the YIG sphere volume a predetermined magnetic field distribution from a signal fed to such strip conductors as previously described in conjunction with FIGS. 11 to 13. However, often it is desirable to prevent coupling of r.f. energy between input section 210 and output section 120 (FIG. 26) through the YIG sphere 238 such as during transmission by a high power transmitter 263 having a frequency equal to $\omega_o$, to prevent magnetic saturation of the YIG sphere and potential damage to the receiver 266 during the transmission period from transmitted energy that leaks into the receiver path. In accordance with the invention, a pulse signal is fed to current feed line 215a (FIG. 22) from driver 410 (FIG. 38) providing a current signal flow ($I_p$) in the strip conductors 214c', 214c'' around the aperture 236 as indicated in FIG. 25. The current in such strip conductors 214c', 214c'' produces in response thereto a magnetic field $H_{DCP}$ around the resonant body. Depending upon the direction of current flow, such field either aids or opposes the external D.C. field $H_{DC}$. In any event, in response to the combination of the pulsed magnetic field $H_{DCP}$ and the external D.C. magnetic field $H_{DC}$, the shifted resonant frequency ($\omega_{os}$) of the magnetically tuned resonant circuit 209 is given as $\omega_{os}=\gamma(H_{DC}\pm H_{DCP})$, or in other words the resonant frequency is changed by an amount equal to $\pm\gamma H_{DCP}$. Thus, during transmission of energy having a frequency $\omega_o$, in response to a current flow through the coupling circuit 217, the magnetically tuned resonant circuit 209 will isolate such energy from the receiver 268 since the transmitted frequency $\omega_o$ thereof will not equal $107_{os}$, the shifted resonant frequency, and thus the resonant condition of absorption of energy will not be satisfied, and such energy will be reflected backwards toward the duplexer 361.

In general, when a plurality of conductors are used to provide a selected r.f. magnetic field distribution, a pulsed current signal fed to such conductors will provide in response thereto, a magnetic field proportional to the total current flow therein. The above structure in addition provides all the improvements in the operating characteristics of the magnetically pulsed tuned resonant circuit 219 such as reduced spurious energy transfer due to reduced activation or coupling to nonuniform resonance modes, reduced eddy current line broadening and substantial elimination of frequency shift, as described in conjunction with FIGS. 16, 17, 17A.

A YIG filter providing a passband of $f_o=20$ MHz where $f_o=\omega_o/2\pi$ at a center frequency of $f_o=10$ GHz, tunable over at least a 500 MHz band in the X-band range having an insertion loss at $f_o$ of less than 1.3 db, and capable of shifting $f_o$ by $\pm 25$ MHz in less than 100 nanoseconds using driver 410 has the following properties:

| Symbol | Description | Value |
|---|---|---|
| w | width of strip conductor 214a, 224c | 15 mil |
| w' | width of strip conductor 214c', 214c' 124c', 121c' | 3 mil 3 mil |
| $w_s$ | width of stubs 214b, 124b | 30 mil |
| | substrate material | alumina |
| $w_c$ | channel width (214b''') | 2 mil |
| h | substrate thickness | 15 mil |
| | substrate diameter | 15 mil |
| k | dielectric constant of substrates 212, 122 | 9.3 |
| D | diameter of void | 60 mil |
| d | separation of coupling circuit conductors at midpoint 214c', 214c'', 124c', 124c'' | 35 mil |
| c | length of coupling circuit | 60 mil |
| | sphere diameter | 15 mil |

Figure 27:
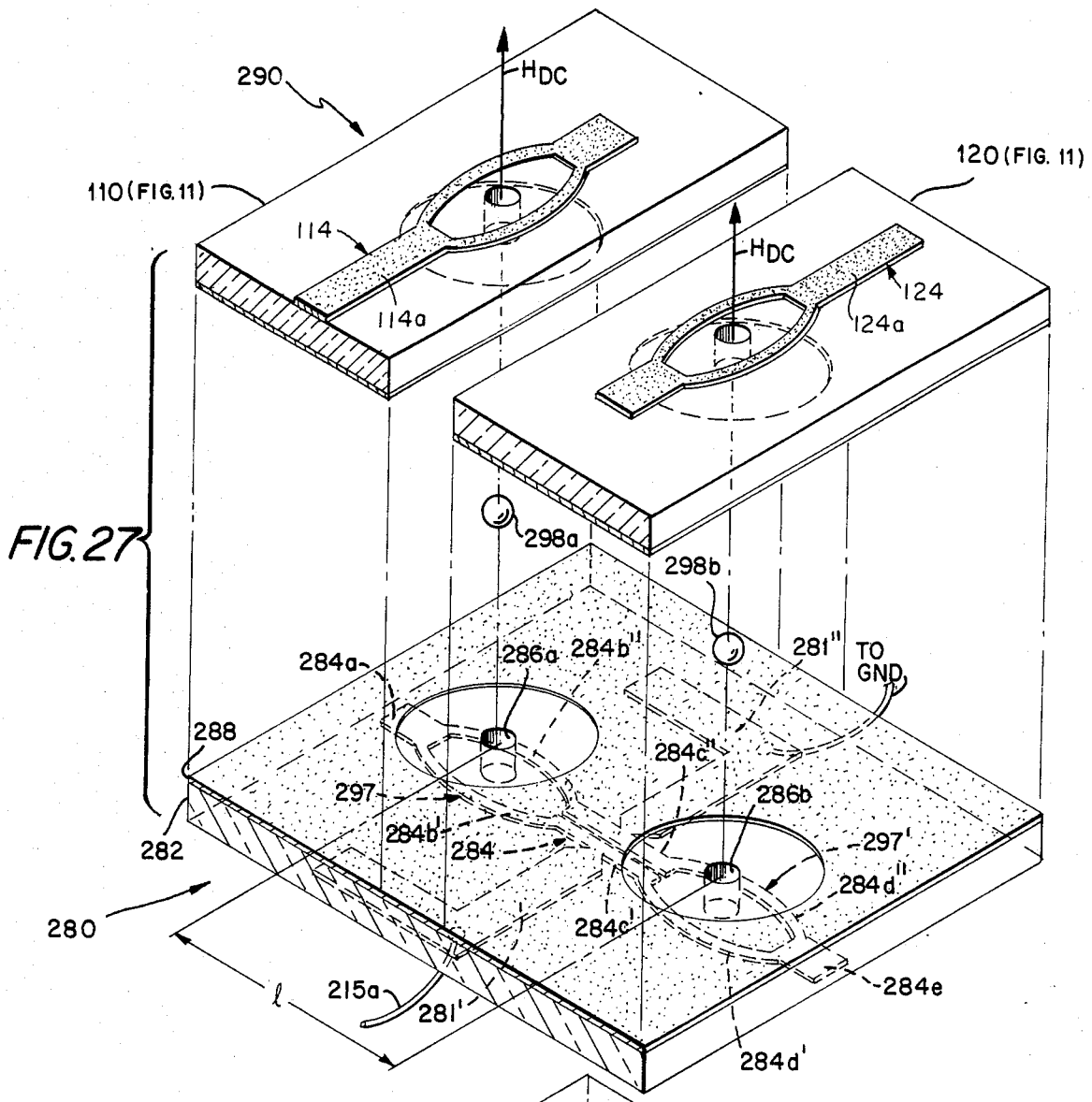
FIG. 27 is an exploded isometric view of a dual-stage magnetically tuned resonant circuit having a pulse field coil in accordance with the invention.
Figure 28:
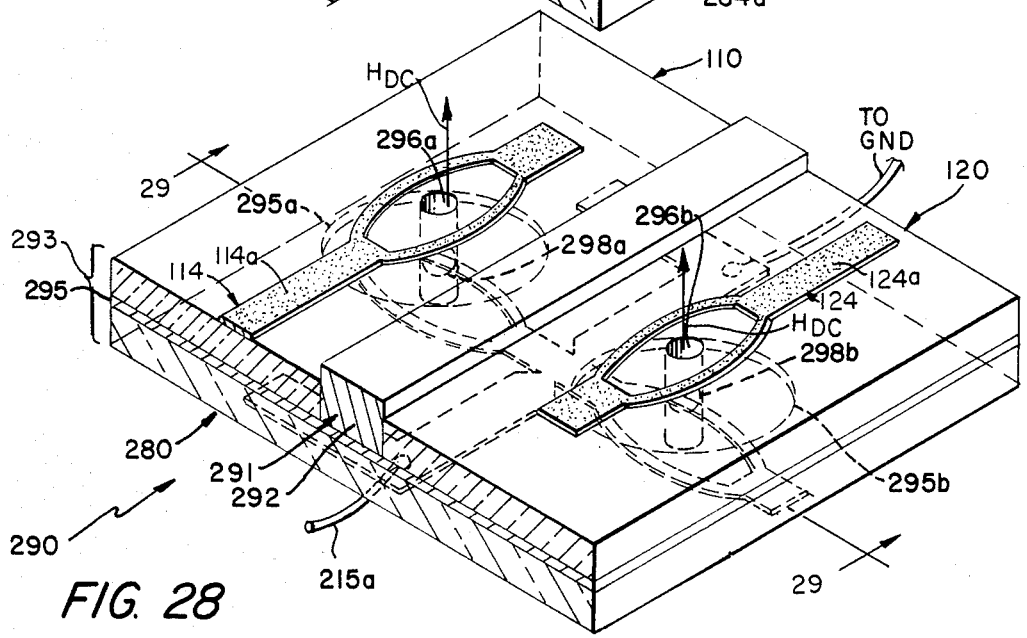
FIG. 28 is an isometric view of the dual-stage magnetically tuned resonant circuit as shown in FIG. 27.
Figure 29:
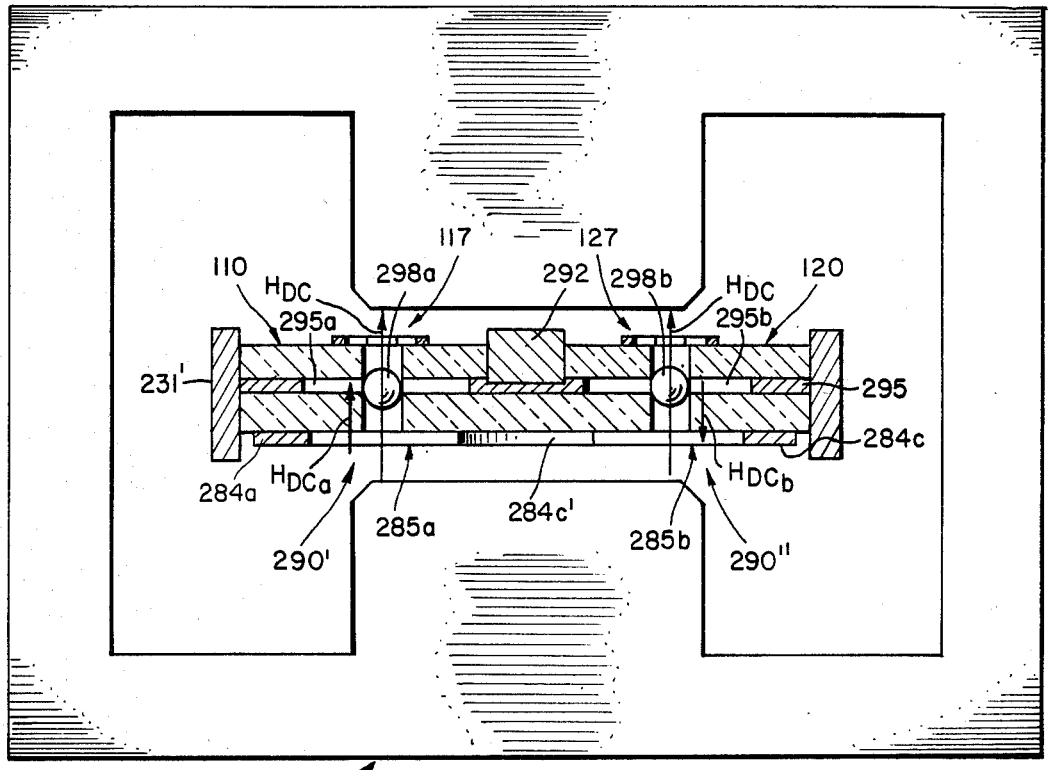
FIG. 29 is a cross-sectional view of FIG. 28 taken along lines 29—29 wherein the circuit is disposed between a magnetic pole piece and a flux return yoke.
Figure 30:
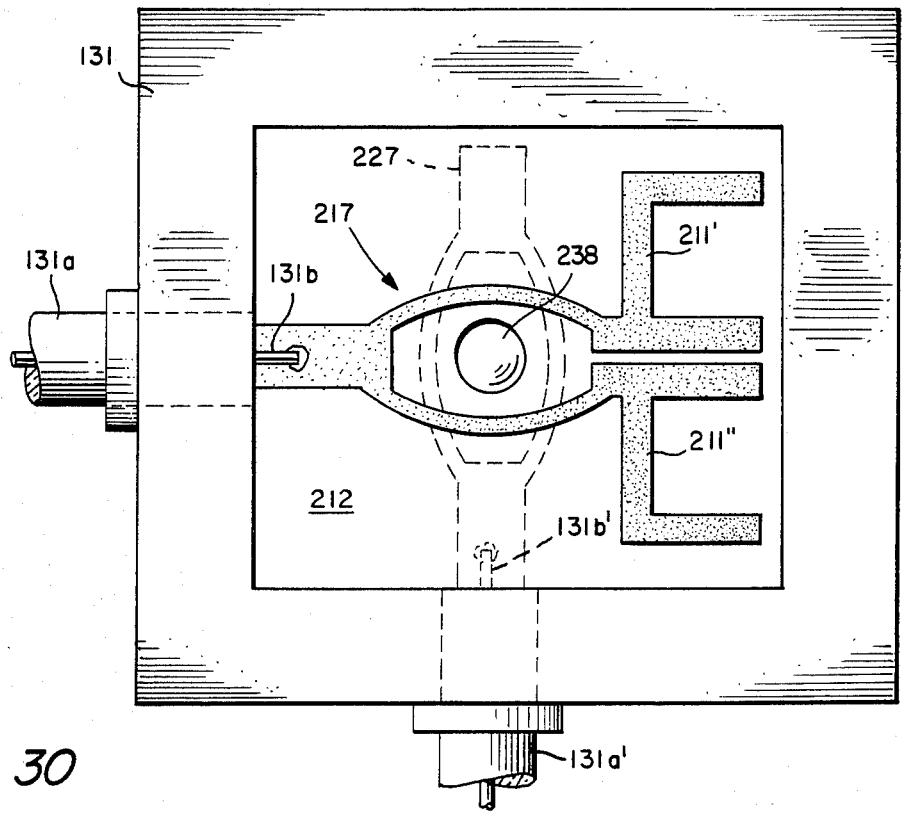
FIG. 30 is a plan view of the magnetically tuned resonant circuit shown in FIG. 23 disposed in a housing.

Referring now to FIGS. 27–29, the fabrication of a dual stage magnetically tuned resonant circuit 290 each having a single pulse field coil integrally formed therein according to the teachings of the invention will be described.

Referring first to FIG. 27, the magnetically tuned resonant circuit 290 is shown to include a first input transmission line section 110, here substantially identical to the input transmission line section 110 described in conjunction with FIG. 11, a first output transmission line section 120 substantially identical to the output transmission line section 120 described in conjunction with FIG. 11, an interstage transmission line section 280, and YIG spheres 298*a*, 298*b* in the presence of magnetic field $H_{DC}$, as shown. Interstage transmission line section 280 here includes a dielectric substrate 282 separating a strip conductor 284 and a ground plane conductor 288, as shown. The strip conductor 284 is provided substantially across the entire length of the substrate 282 (having a length, $l_1$, equal to $(2n+1)\lambda/4$ wavelengths where $(2n+1)$ is an odd multiple multiplier) and includes a pair of quarter wavelength stubs 284*a*, 284*e*, two pairs of planar spaced strip conductor segments 284*b'*, 284*b''*, and 284*d'*, 284*d''* providing interstage coupling circuits 285*a*, 285*b* and corresponding strip conductors 284*c'*, 284*c''* coupling together such segments 284*b'*, 284*b''* and 284*d'*, 284*d''*, as shown. Stub portions 284*a*, 284*e* have a length in combination with a portion of a corresponding one of the coupling circuits 285*a*, 285*b* to provide a corresponding length, l, as previously described in conjunction with FIG. 11. Provided in the substrate 282 between each pair of such spaced strip conductors 284*b'*, 284*b''* and 284*d'*, 284*d''* is a corresponding aperture 286*a*, 286*b*, respectively, through such substrate 282 and ground plane conductor 288, as shown. Portions of the ground plane conductor 288 in the area adjacent such apertures 286*a*, 286*b* are removed, exposing portions 282*a*, 282*b* of the substrate 282 and the apertures 286*a*, 286*b* therein as described in conjunction with FIG. 11. The distance $l_2$ between the centers of such apertures is an odd multiple $(2n+1)$ of a quarter wavelength $\lambda/4$ where n is an integer. Each length, l, of the strip conductor 284 and portions of the coupling circuits 285*a*, 285*b* and the distance $l_2$ between the apertures 286*a*, 286*b* are chosen to be an odd multiple of a quarter wavelength in order to preserve the r.f. short circuits at the center of each aperture 286*a*, 286*b*, as previously described, and to maintain a uniform balance of electrical characteristics across such strip conductor 284.

The microstrip transmission line 280 further includes a first center tapped half wavelength ($\lambda/2$) strip conductor stub 281' integrally formed at first end with the center of split strip conductor portion 284*c'* and terminated at a second end in an open circuit (O). The center of such stub 281' is connected to an input current feed line 215*a*. A second $\lambda/2$ center tapped strip conductor stub 281'' is shown integrally formed at a first end to the split strip conductor 284*c''* and terminated at a second end in an open circuit (O). The center of the stub 281'' provides a return path for line 215*a*, as previously described. Strip conductor stubs 281', 281'' are here provided to block flow of r.f. energy through the current bias source, as previously described. Here by providing an open circuit at the ends of each stub 281', 281'', respectively, a short circuit to r.f. energy is provided at the center taps of each stub, as previously described, and at the ends connected to split conductors 285', 285'' an r.f. open circuit (o) to r.f. energy is thus provided since one quarter of a wavelength therefrom at each center tap there is a short circuit. Substantially complete r.f. isolation from the current source is thus provided by this configuration since the interstage transmission line section has coupled thereon only resonant frequency energy having a wavelength corresponding to the length of such stubs as described above.

As shown more clearly in FIG. 28, the YIG spheres 298*a*, 298*b*, the input transmission line section 110, the output transmission line section 120, and the interstage transmission line section 280 are joined together to provide a composite transmission line body 293. The transmission line sections 110, 120, 280 are joined together providing a single ground plane 295, as shown. A channel 291 is obtained between such microwave transmission line sections 110, 120 when such sections 110, 120 are disposed on the interstage transmission line section 280. A conductive slab 292 is provided in the channel 291 between such transmission line sections 110, 120. Conductive slab 292 here provides a conductive path to the ground plane 295 between input transmission line section 210 and output transmission line section 120 to prevent direct coupling of signals therebetween. A pair of apertures 296*a*, 296*b* through the dual stage magnetically tuned resonator 290 are provided from apertures 216, 286*a* and 226, 286*b*, as previously described in conjunction with FIGS. 11–13, for aperture 136. Each aperture has associated therewith a void 295*a*, 295*b* in the ground plane 295, as previously described in conjunction with FIG. 12. A first stage 290' (FIG. 29) of the dual stage magnetically tuned resonant circuit 290 is shown to include the YIG sphere 298*a* disposed in aperture 296*a*, and a second stage 290'' of the resonant circuit 290 is shown to include the YIG sphere 298*b* disposed in aperture 296*b*.

In a first mode of operation, a portion of an r.f. signal fed to the strip conductor 114 of input transmission line 110 is coupled to the strip conductor 124 of output transmission line 120 in a manner to be described. The external D.C. magnetic field $H_{DC}$ is applied normal to the surface of the resonator 290 with $H_{DCp}$ the pulsed magnetic component zero for the first mode of operation. Input microwave frequency energy is fed to strip conductor 114 at end portion 114*a* to the first stage 290' in the presence of the DC magnetic field, $H_{DC}$. In accordance with the equation $\omega_o=\omega_i$, a portion of such input energy having a frequency substantially equal to $\omega_o$ is transferred to the spins of the electrons in YIG sphere 298*a*, disposed in aperture 296*a*, as previously described in conjunction with FIGS. 24–25, causing such electron spins to precess in a direction along the Z axis (in a direction parallel to the magnetic field $H_{DC}$) at a frequency $\omega_o$, as is well-known in the art. In a like manner, as previously described in conjunction with FIGS. 24–25, an r.f. magnetic field is produced about the sphere 298*a* and a magnetic moment of the precession of electrons in the X direction is produced in the Y direction, enabling coupling of such energy to the first interstage coupling circuit 285*a*. Such coupled energy is then fed along such strip conductor 284*c* to the second interstage coupling circuit 285*b*. In a similar manner, as described above, substantially all of the energy fed to coupling circuit 285*b* is transferred to the spins of the electrons in the YIG sphere 298*b* and in a similar manner as described above such energy is then coupled to the strip conductor 124 and fed to the output terminus 124*a* thereof. Suppression of magnetostatic resonance modes, line broadening and frequency shift effects as described in conjunction with FIGS. 16, 17, 17A for the single stage resonator 109 in a like manner applies to the magnetically tuned resonant circuit 290. Since in each single stage 290', 290'' of the dual-stage magnetically tuned resonator 290 the magnetostatic resonance modes are suppressed, the dual-stage filter may be designed using two pure crystal YIG spheres. Further, the dual resonator 290 will have lower insertion loss and enhanced temperature performance due to reduction or elimination of line broadening and frequency shift effects, as described above for the magnetically tuned resonant circuit 209.

In a second mode of operation, r.f. energy is fed to transmission line section 110, but the magnetic fields around the spheres 298*a*, 298*b* are modified by pulsed DC magnetic fields $H_{DCp}$ to change the resonant frequency of the YIG spheres 298*a*, 298*b* and hence prevent coupling of energy to output transmission line section 120. In this manner, the magnetically tuned resonant circuit is detuned for r.f. energy of a frequency $\omega_o$ and thus reflects such energy back towards the source and provides protection to the receiver 268. Prior to the time of arrival of such r.f. energy a voltage pulse signal is fed to the driver circuit 410 (FIG. 38) to provide a current pulse on line 215*a* which is synchronized to the flow of such r.f. energy, as shown in FIG. 39. A current flow from current line 215*a* in two paths around the YIG spheres 298*a*, 298*b* is provided. A first path is provided around a single turn coil 297 formed by stub 281', strip conductor portions 284*c'*, 284*b'*, 284*b''*, 284*c''* and stub 281'' providing in response to such current flow a pulsed d.c. magnetic field $H_{DCp}$ having an orientation normal to the surface of the magnetically tuned resonant circuit 290 and a direction upward, as shown in FIG. 14. A second path is provided around a coil 297' formed by stub 281' strip conductor portion 284*c'*, 284*d'*, 284*d''* and stub 281'' providing in response to such current flow a pulsed d.c. magnetic $H_{DCpb}$ having an orientation normal to the surface of the magnetically tuned resonant circuit 290 and a direction downward, as shown in FIG. 14. Thus, in the presence of an externally applied d.c. magnetic field $H_{DC}$, the pulsed fields $H_{DCa}$ and $H_{DCb}$ either aid or oppose the field $H_{DC}$, thus shifting the resonance frequency of each resonator accordingly. For resonator A, the shifted resonant frequency $\omega_{oAs}$ is given by $\omega_{oAs}=\gamma(H_{DC}\pm H_{DCpa})$ and for resonator B the shifted resonant frequency is given as $\omega_{oBs}=\gamma(H_{DC}\mp H_{DCpb})$.

Figure 31:
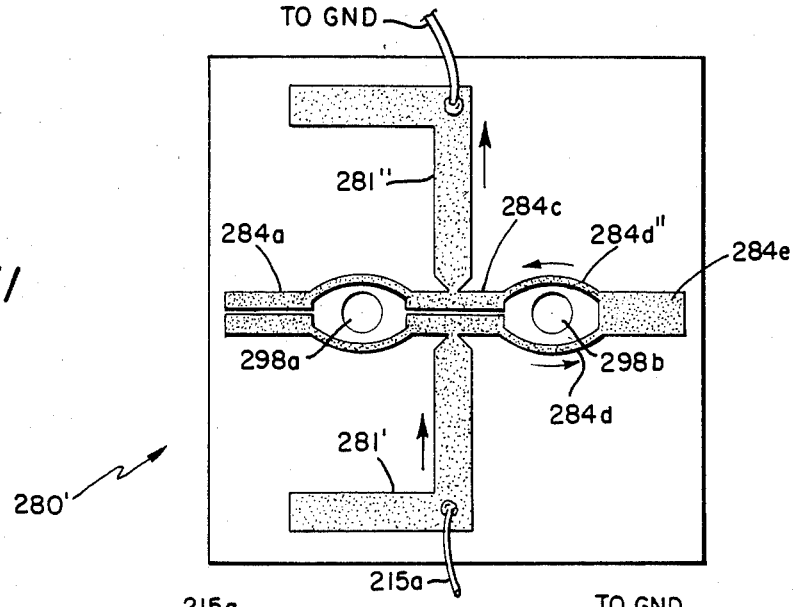
FIGS. 31–33 are a series of plan views of alternate configurations of pulse field current paths provided in accordance with the invention.
Figure 32:
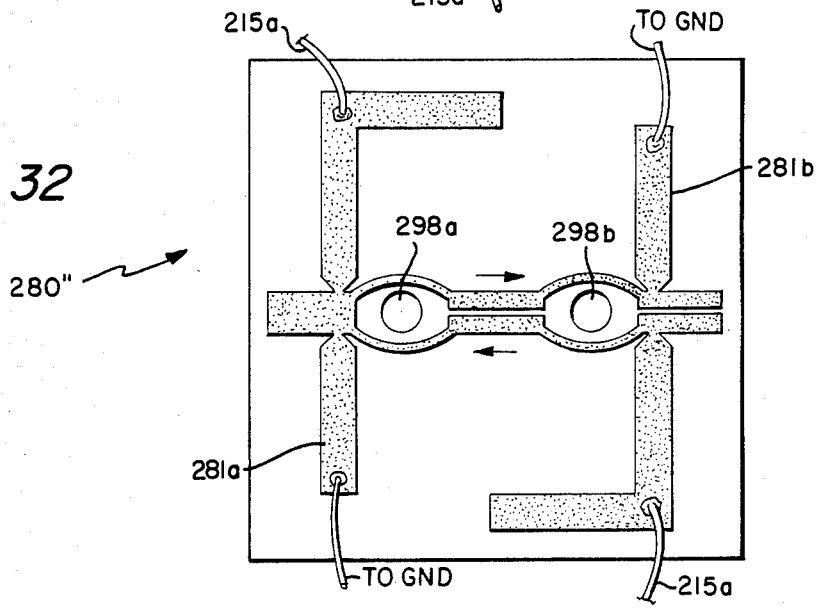
Figure 33:
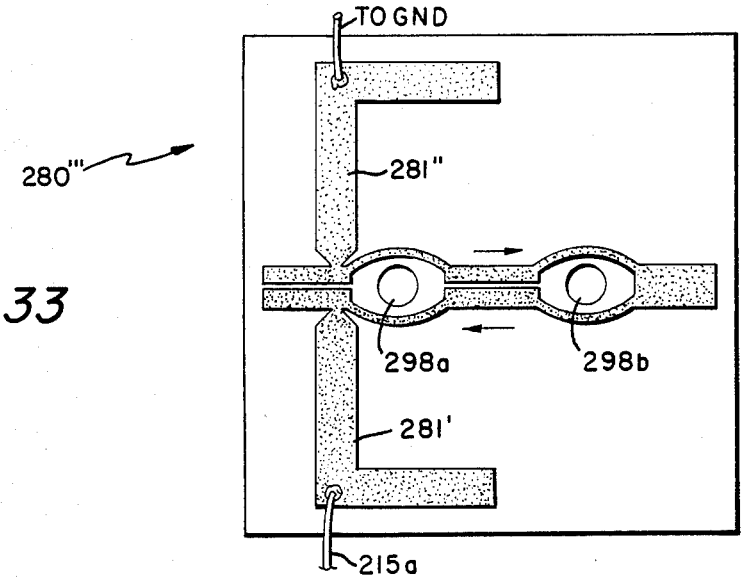

Referring now to FIGS. 31, 32 and 33, alternate configurations for selectively shifting the resonant frequencies of the magnetically tuned resonators are shown. An interstage transmission line 280 shown in FIG. 27 is configured by splitting the strip conductor portion 284*a* and the strip conductor portion 284*c* to provide a single current loop here around the YIG sphere 298*b* to frequency shift the resonance frequency of stage 290''. No current path is provided around resonator A, since stub 284*a* was split lengthwise to prevent coupling to a return path. There is no frequency shift of the resonant frequency of YIG sphere 298*a*. In FIGS. 32, 33 are shown alternate interstage transmission line sections 280'', 280''' provided to shift YIG sphere 298*a* and YIG sphere 298*b* in the same direction by providing a current path around each one of the resonators and having a current in each path flowing in the same direction around such resonators using a pair of such driver circuits 410 (FIG. 32). In addition as shown in FIG. 33, stub portions 281*a*, 281*b* have $\lambda/4$ portions which are here connected directly to ground to provide an effective r.f. open circuit at the respective coupling circuits, as is known in the art.

Referring now to FIGS. 34, 35, 36 and 37 an alternate embodiment of a frequency stepped magnetically tuned resonant circuit 309 here a bandpass filter will be described.

Figure 34:
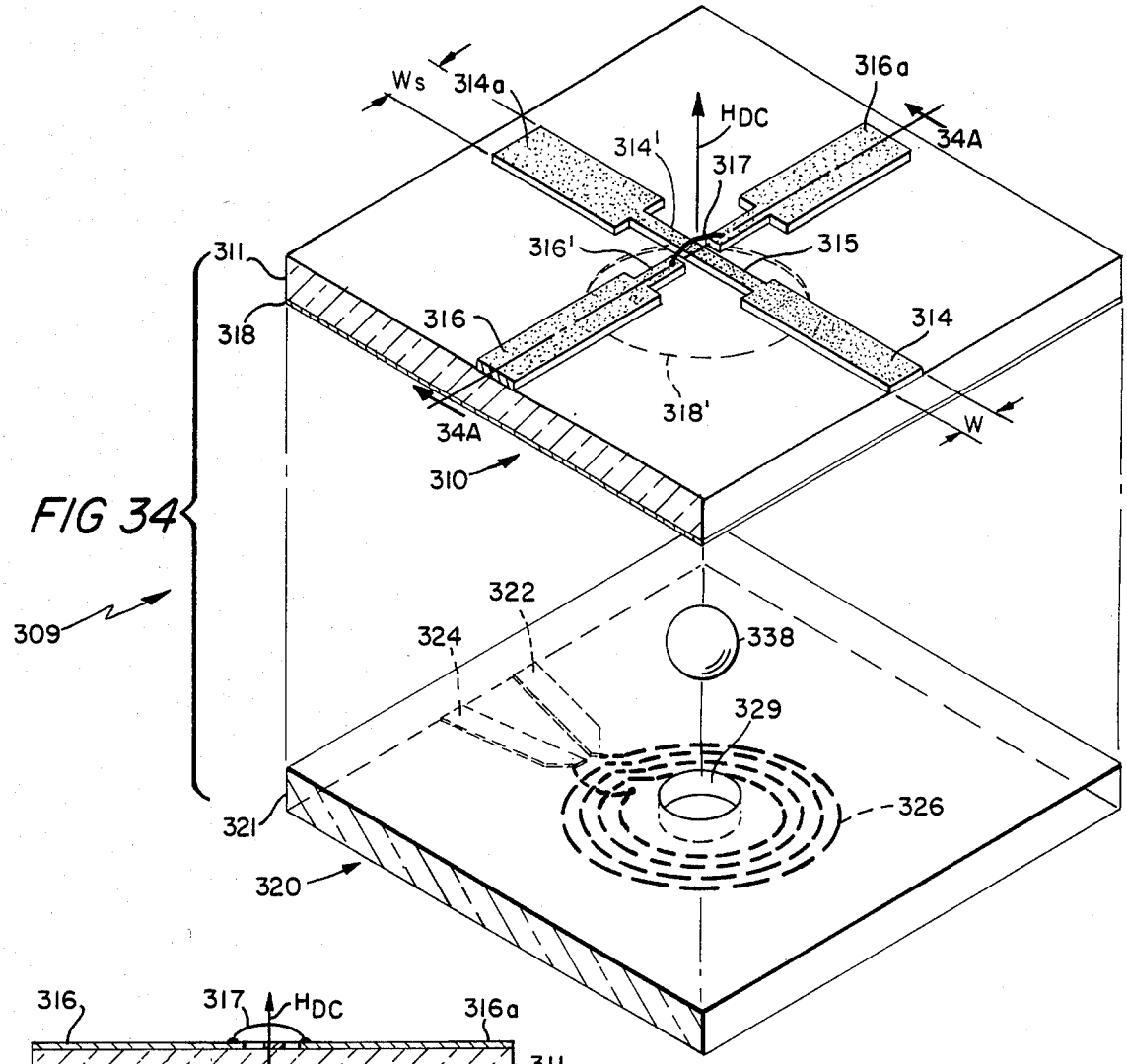
FIG. 34 is an exploded isometric view of an alternate embodiment of a magnetically tuned resonant circuit having a pulse field coil.
Figure 36:
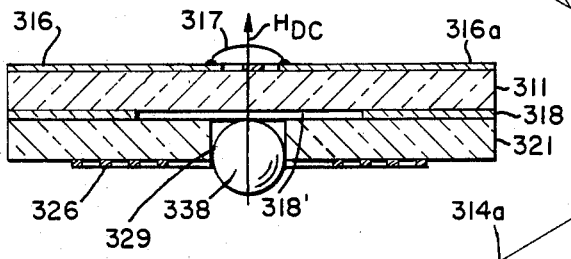
FIG. 36 is a cross-sectional view of FIG. 35 taken along lines 36—36 wherein the circuit is disposed between the magnetic pole piece and flux return yoke.

Referring first to FIG. 34, a coupling circuit section 310 is shown to include a dielectric substrate 311 supporting a first strip conductor 314 which is connected to a corresponding quarter wavelength stub 314*a*, via a thinner portion 314' of strip conductor 314 and a second strip conductor 316 which is connected to a corresponding quarter wavelength stub 316*a*, via a thinner portion 316' of strip conductor 316 and a conductor 317 which crosses or bridges over conductor 314' and is dielectrically spaced therefrom. Here a bonding wire is shown as conductor 317, but a plated overlay as known in the art may alternatively be used. On a surface of substrate 311 opposite the surface supporting the strip conductors 316, 314 is provided a ground plane conductor 318. A void 318' is provided in the ground plane conductor 318 exposing an underlying portion of the dielectric substrate 311.

The magnetically tuned resonant circuit 309 also includes a YIG sphere 338 and a coil section 320 having a substrate 321 supporting a pair of strip conductors 322, 324 and a spiral coil 326. Such a pair of strip conductors 322, 324 are provided to make electrical contact to the coil 326, and to provide means to couple thereto a current source such as the circuit 410 described in conjunction with FIG. 38. An aperture 329 is provided in the substrate 321 for disposing therein the YIG sphere 338. The YIG sphere 338 is here held in aperture 329 by a suitable low loss epoxy.

Figure 35:
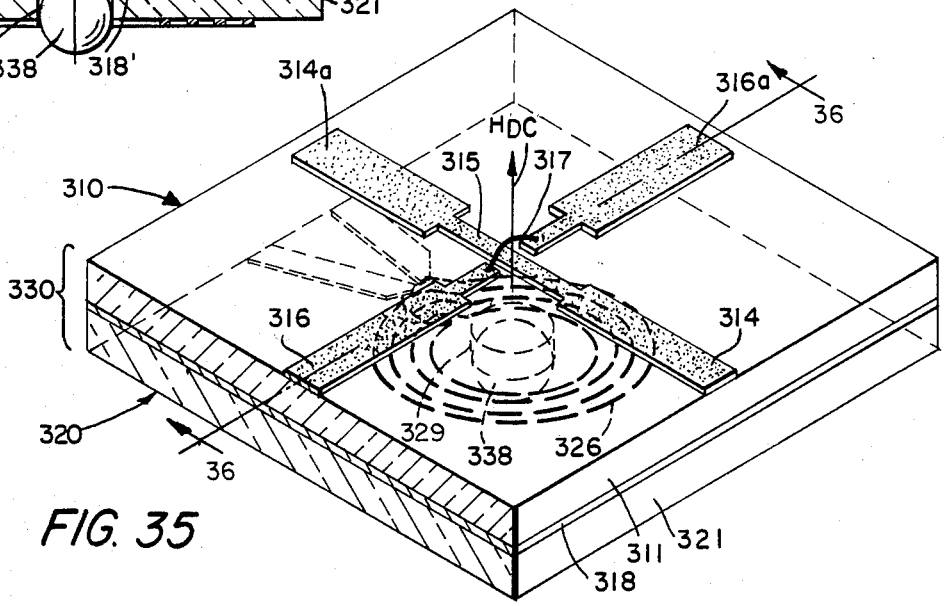
FIG. 35 is an isometric view of the embodiment shown in FIG. 34.
Figure 37:
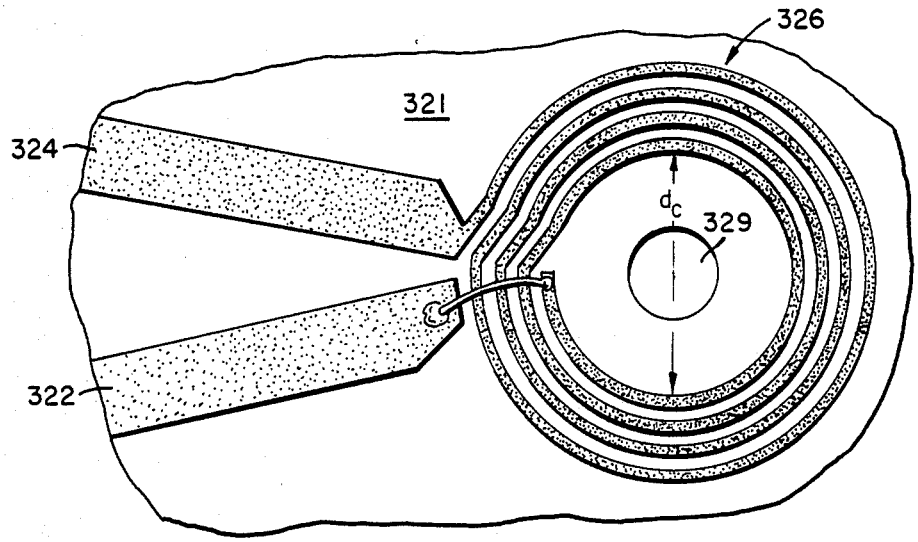
FIG. 37 is an exploded plan view of a coil used in the alternate embodiment of the invention shown in FIG. 35.

As shown more clearly in FIG. 35, the transmission line section 310 and coil section 320 are joined together, providing a composite body 330 and such that the ground plane conductor 318 is intermediate the strip conductors 314, 316 and the coil 320. The transmission line section 310 and the coil section 320 are further mounted such that the aperture 329 formed in the substrate 321 is concentrically aligned with the void 318' in ground plane 318. As shown, the YIG sphere 338 is here exposed in aperture 329. Here in order to provide maximum pulsed magnetic field intensity, the YIG sphere 338 is disposed in aperture 329 such that the coil 326 is symmetrically disposed about the YIG sphere 338. In a first mode of operation, r.f. energy is coupled between such coupling circuits through the YIG sphere 338, in a manner as previously described. In a second mode of operation, a current pulse signal here fed from driver 310 (FIG. 38) is fed to one of such strip conductor lines such as 322 with line 324 providing a return path. In response to such current flow around coil 326 a large pulsed D.C. magnetic field $H_{DCp}$ is provided. Thus, the resonant frequency of the YIG sphere 338 is shifted in accordance with the equation $\omega_o=\gamma(H_{DC}\pm H_{DCp})$ and substantial isolation of energy having a frequency $\omega_o=\gamma H_{DC}$ is provided as previously described. The coil 326 (FIG. 22) is here used to rapidly switch the pulsed D.C. magnetic field $H_{DC}$ on and off as desired. As shown in FIG. 25 in operation, when the frequency stepped magnetically tuned resonant circuit 309 is located adjacent transmitter 263, for example, to prevent a portion of the transmitted high energy from being coupled through the frequency stepped magnetically tuned filter, on transmit, a current signal is here fed to such coil 326 to rapidly switch the d.c. magnetic field $H_{DCp}$ on and hence to change the resonant frequency in accordance with the equation $\omega_o=\gamma(H_{DC}\pm H_{DCp})$ as previously described. Since a current pulse is being fed through a coil 326 here having a relatively low inductance, and which is proximately and concentrically spaced from the YIG sphere 338, the magnetic field $H_{DCp}$ can be pulsed on or off rapidly in such region thereby permitting the magnetically tuned resonator to selectively isolate or couple resonant frequency to energy fed to the input transmission line 314. Further, by mounting the coil on the surface of the substrate 320 (FIG. 34), substrate 12 (FIG. 1), the thermal energy generated by passing a relatively large current signal therethrough is dissipated faster, enabling longer pulsed operation and higher pulse duty cycles, of current to create the pulsed magnetic field $H_{DCp}$. As previously described in conjunction with FIG. 22, r.f. decoupling $\lambda/2$ stubs may be used in conjunction with coil 226 to prevent coupling of r.f. energy coupled to such coil 226.

A YIG filter providing a passband of $f_o=23$ MHz where $f_o=\omega_o/2\pi$, at a center band frequency of $f_o=10$ GHz, tunable over at least a 500 MHz band in the X-band range, having an insertion loss of less than 1 db and capable of shifting $f_o$ by $\pm 300$ MHz in less than 50 nanoseconds using driver 410, has the following characteristics:

| Symbol | Description | Value |
|---|---|---|
| w | width of conductor 314, 316 | 10 mil |
| w' | width of conductor 314', 316' | 2.5 mil |
| $w_s$ | width of stub 314a, 316a | 30 mil |
| h | substrate thickness | 10 mil |
| k | dielectric constant | 9.3 |
| $h_1$ | spacer thickness | 10 mil |
| D | diameter of void 318' | 50 mil |
| $d_c$ | inner diameter of first turn of coil 326 | 45 mil |
| | number of turns | 4 mil |

Figure 40:
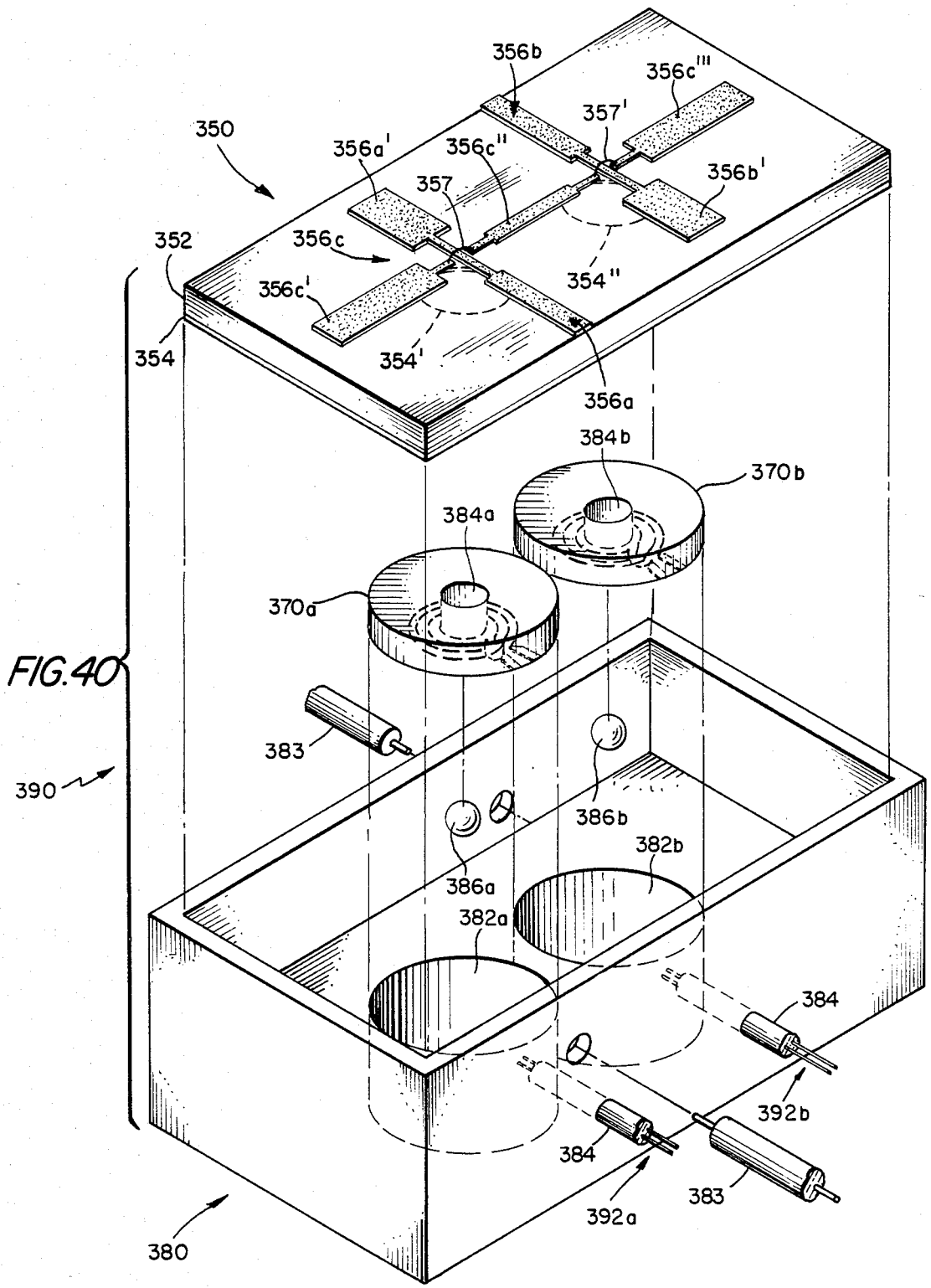
FIG. 40 is an exploded isometric view of an alternate embodiment of a dual-stage magnetically tuned resonant circuit with a pulsed field coil.

Referring now to FIGS. 40, 41 and 42, an alternate embodiment of a frequency stepped dual-stage magnetically tuned resonant circuit 390 will be described. Referring first to FIG. 40, a dual-stage coupling circuit section 350 is shown to include a dielectric substrate 352 separating a ground plane 354 from strip conductors 356*a*, 356*b*, 356*c*, as shown. Strip conductor 356*c* here includes discrete strip conductors 356*c'*, 356*c''* and 356*c'''* connected together by plated overlays (as known in the art) or by here bonding wires 357, 357'. In a similar manner as described in conjunction with FIG. 34, such conductors 356*a*, 356*b*, 356*c* here form a pair of coupling circuits 358, 358'. Here sections 356*a'*, 356*b'* of strip conductors 356*a*, 356*b* provide $\lambda/4$ stubs as does sections 356*c'* and 356*c'''* as described above. Portions 354', 354'' of the ground plane conductors 354 are removed exposing underlying portions of the dielectric substrate 352.

The magnetically tuned resonant circuit 320 also includes a pair of coil sections 370*a*, 370*b* here substantially identical to the end section 320 previously described. Here such coil sections are embedded in a corresponding pair of apertures 382*a*, 382*b* provided in a housing 380 by a suitable low loss epoxy. In a similar manner, YIG spheres 386*a*, 386*b* are likewise epoxied into apertures 384*a*, 384*b* provided in coil sections 370*a*, 370*b* as previously described. Housing has attached thereto coaxial connectors and launchers 383 and connector 384 (to feed current pulses to the coil sections), as shown.

As shown more clearly in FIGS. 41 and 42, the coupling section 350 is disposed in housing 380 as are YIG spheres 386*a*, 386*b* and coil sections 370*a*, 370*b* to provide the frequency step magnetically tuned dual-stage filter 390. By providing a current pulse to the coil, here lines 392*a*, 392*b* which are connected to the coils 370*a*, 370*b*, the magnetic fields $H_{DCpa}$, $H_{DCpb}$ are provided to shift the resonant frequency of each sphere 386*a*, 386*b* as previously described in conjunction with FIGS. 34–36.

Alternatively, the coupling section 310 may include a plurality of conductors, for the coupling sections 314', 316', to distribute energy fed thereto and hence shape the r.f. magnetic field as previously described. Also, the coil 326 as described above may be incorporated in the embodiments described in conjunction with FIGS. 1–33.

Figure 43:
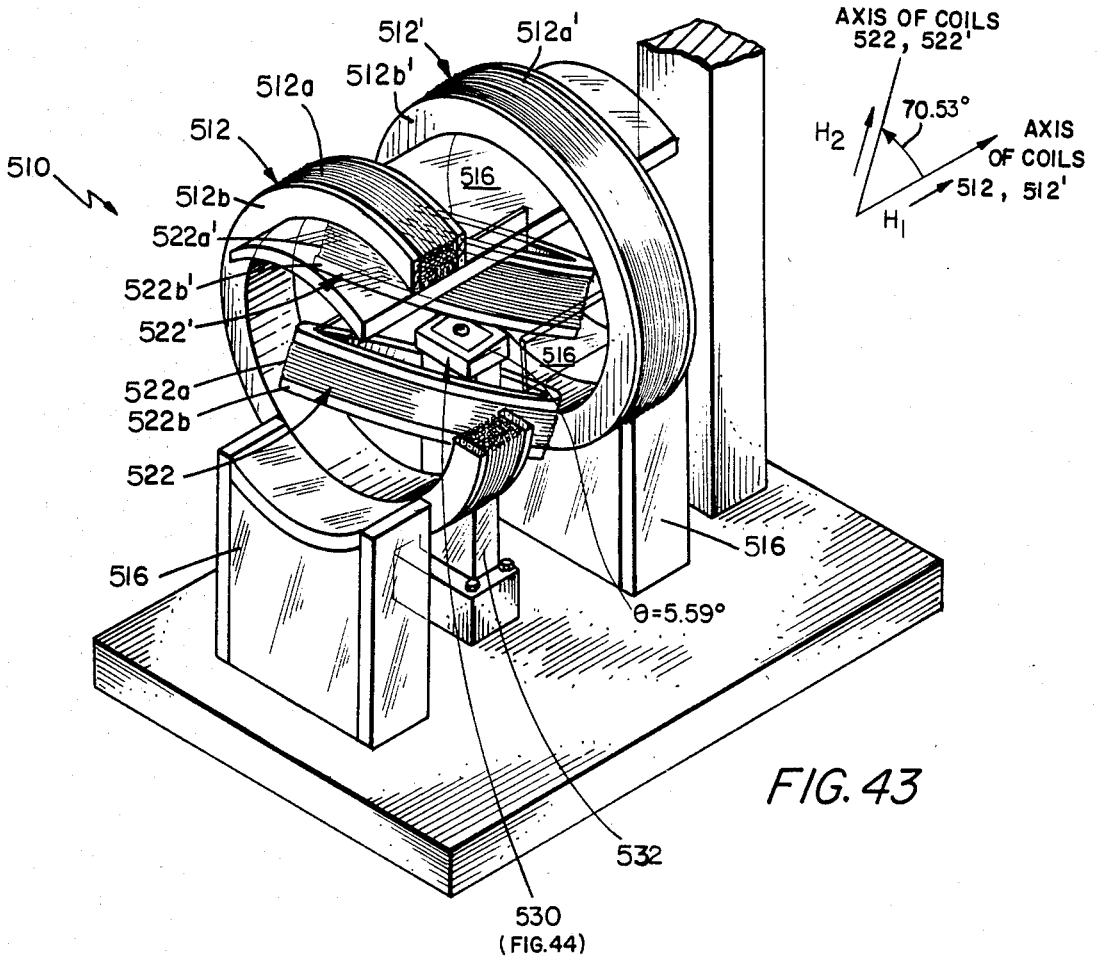
FIG. 43 is an isometric view of an apparatus for orientating YIG spheres.

Referring now to FIG. 43, an apparatus 510 for orientating a ferrimagnetic sphere along a predetermined crystallographic direction includes a first pair of coils 512, 512' here including wire conductors 512*a*, 512*a'* wound around plastic cores 512*b*, 512*b'*. Coils 512, 512' are arranged in a corresponding plastic support 516. Coils 512, 512' provide a magnetic field $H_{(1)}$ of here 1000 gauss in a horizontal or Y direction, as shown. The apparatus 510 also includes a second pair of coils 522*a*, 522' here including wire conductors 522, 522*a'* wound around plastic cores 522*b*, 522*b'*. Coils 522, 522' are arranged on the plastic support 516 and are disposed within the region confined by the first pair of coils 512, 512'. The axis of such coils 522, 522' are disposed at an angle $\theta$ of here 70.53° with respect to the axis of the first pair of coils 512, 512', as shown. Coils 522, 522' provide a second magnetic $H_2$ of here 1000 gauss. The apparatus further includes a platform 530 (FIGS. 44, 45) centrally disposed between such pairs of coils 512, 512', 522, 522', as shown. Each pair of coils 512, 512', 522, 522' are arranged in such a way as to provide a magnetic field between each of such pair of coils having directions which correspond to a so-called "easy axis" of the sphere.

Figure 44:
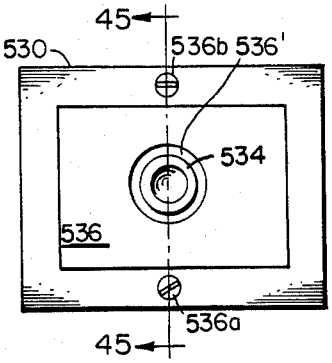
FIG. 44 is a plan view of a platform portion of the apparatus shown in FIG. 43.
Figure 45:
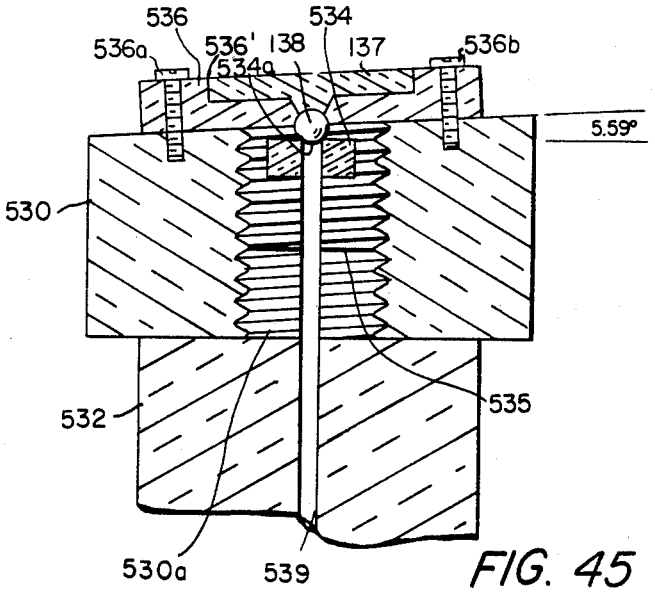
FIG. 45 is a cross-sectional view taken along lines 45—45 of the platform shown in FIG. 44.

Referring now to FIGS. 44 and 45, the platform 530 here of Lucite is supported by a support rod 532 here of Lucite having a first surface 530' here opposite the support rod 32 disposed at a predetermined direction with respect to the horizontal plane of the apparatus 510. Here the surface is inclined at an angle $\phi$ of 5.59° with respect to the horizontal direction. A threaded aperture 530*a* is provided in the platform 530 and a nylon screw 535 is threaded therein. The nylon screw 535 is inserted normal to the horizontal direction and has an upper portion wherein is embedded a watch jewel 534 here of sapphire. The watch jewel 534 has a recessed portion 534*a* to support the YIG sphere 138 (FIG. 13). The nylon screw 35 is provided to adjust the position of the YIG sphere 138, to accommodate the apparatus for here a variety of YIG spheres of various diameters. As shown in FIG. 45, the screw 535 and watch jewel 534 have an aperture 539 therein for applying a small negative pressure to hold the YIG sphere 138 in the recess 534*a*. A cover member 536 having an aperture 536' corresponding in size and shape to the YIG sphere support 137 (FIG. 13) is then fastened with screws 536*a* and 536*b* to the platform 530 along the inclined surface portion 530' thereof. The apparatus 510 is here used to orientate the sphere 138 as follows: a negative pressure is initially applied through aperture 539 to insure that YIG sphere 138 is properly disposed in the recessed portion 534*a* of watch jewel 534; the negative pressure is then removed; a series of pulses of current from a current means (not shown) are alternatively applied to each coil of such pairs of coils 512, 512', 522, 522', in turn, at intervals of here one pulse every 20 seconds, with such pulse having a pulse width of approximately 100 ms; in response to each pulse of current to each pair of coils 512, 512', 522, 522' a magnetic field $H_1$, $H_2$ is generated, in turn, between each pair of coils and the YIG sphere 138 rotates in response to each of such fields tending to align itself such that a pair of coplanar body diagonals of the sphere's crystallographc structure are parallel with the directions of the field $H_1$, $H_2$; after approximately five to six minutes of alternate pulsing of each pair of such coils, the YIG sphere 138 is orientated such that the magnetic fields $H_1$, $H_2$ are aligned with one of the "easy axis" of the sphere's structure. Temperature invariant orientation of the YIG sphere 138 is provided when the sphere support 137 is brought into contact with the sphere 138 since the sphere support 137 is brought into contact with the sphere 138 normal to the inclined surface 530' and at the bias angle $\phi$ with respect to the vertical axis of the sphere ($\phi$ is here equal to the incline of the platform surface 30'). Thus, the YIG sphere 138 is orientated about a temperature invariant axis with respect to the direction of engagement of the YIG sphere support 137 with the YIG sphere 138, since the YIG sphere support 137 engages the YIG sphere at an angle of 5.59° removed from the vertical axis of the sphere 138. Initial alignment of the sphere 138 so that the easy axis of the sphere's crystallographic structure are aligned with the axes of the coils in combination with a calibrated attachment of the sphere support 137 at a predetermined direction with respect to the vertical direction of the initially aligned sphere 138 on the axes of the coils, provides a sphere 138 orientated about a temperature invariant axis. In order to check orientation, several methods may be used including X-ray diffraction analysis as known in the art, or by testing performance of such sphere in one of the magnetic tuned resonant circuits previously described in conjunction with FIGS. 1–42.

Having described preferred embodiments of the invention, it will now be apparent to one of skill in the art that other embodiments incorporating its concept may be used. It is believed, therefore, that this invention should not be restricted to the disclosed embodiment, but rather should be limited only by the spirit and scope of the appended claims.

What is claimed is:

1. A magnetically tuned resonant circuit comprising:

(a) input and output transmission lines comprising:
  (i) a first dielectric;
  (ii) a first ground plane conductor disposed on a first surface of said first dielectric;
  (iii) a pair of strip conductors disposed on said first surface of said first dielectric, and dielectrically spaced from said ground plane conductor with one of said strip conductors being an input strip line and the other one being an output strip line;

(b) an interstage transmission line body comprising:
  (i) a second dielectric;
  (ii) a second ground plane conductor disposed on a surface of said second dielectric; and
  (iii) a strip conductor disposed on said surface of said second dielectric and dielectrically spaced from said second ground plane conductor; and (c) means, including a pair of gyromagnetic resonant bodies, for coupling energy between the input line and output line, with energy fed to the input line being coupled to the interstage line through a first one of the magnetic resonant bodies, said energy propagating along the interstage line and being coupled to the output line through the second one of the magnetic resonant bodies.

2. The circuit as recited in claim 1 further comprising means for spacing the pair of resonant bodies between a corresponding one of the pair of strip conductors and a corresponding portion of the strip conductor of the interstage line.

3. The circuit as recited in claim 2 wherein said spacing means comprises a dielectric member having a pair of apertures and wherein each body is disposed in a corresponding one of said apertures.

4. A magnetically tuned resonant circuit comprising:

(a) an input, output transmission line comprising:

(i) a first dielectric;

(ii) a first ground plane conductor;

(iii) a pair of strip conductors, each disposed on a first surface of said first dielectric, and dielectrically spaced from said ground plane conductor, with one of said strip conductors being an input strip line of the input transmission line and the other one being an output strip line of the output transmission line;

(b) an interstage transmission line comprising:

(i) a second dielectric;

(ii) a second ground plane conductor;

(iii) a third strip conductor disposed on a first surface of said second dielectric and dielectrically spaced from said second ground plane conductor with said third strip line being an interstage strip line of the interstage transmission line;

(c) means, including a pair of gyromagnetic resonant bodies, for coupling energy between the input transmission line and output transmission line, with energy fed to the input transmission line being coupled to the interstage transmission line through a first one of the magnetic resonant bodies, said energy propagating along the interstage transmission line and being coupled to the output transmission line through the second one of the magnetic resonant bodies; and (d) means for reducing direct coupling of energy between the input and output transmission lines.

5. The circuit as recited in claim 4 wherein the first ground plane conductor is disposed on said first surface of said first dielectric and portions of said pair of strip conductors are dielectrically spaced from said ground plane conductor by a corresponding one of first and second pairs of channels disposed between said first ground plane conductor and pairs of strip conductors along the length of said pair of strip conductors; and wherein the second ground plane conductor is disposed on said first surface of said second dielectric and portions of the strip conductor disposed on the second dielectric are dielectrically spaced from the second ground plane by a third pair of channels disposed between said second ground plane conductor and strip conductors along the length of said third strip conductor.

6. The circuit of claim 5 wherein said direct coupling reducing means comprises:

said strip conductors of said input, output transmission line body having end portions which diverge one from the other.

7. The circuit of claim 5 wherein said direct coupling reducing means comprises:

a first channel of each one of the first and second pairs of channels having a width selected in accordance with the width of the corresponding second channel of each one of the pair of channels to provide a substantial zero flux difference between the corresponding strip conductor and adjacent portions of the ground plane conductor.

8. The circuit of claim 5 wherein said direct coupling reducing means comprises:

a conductive member disposed between the pair of strip conductors in electrical contact with the first ground plane conductor.

9. The circuit of claim 5 wherein said direct coupling reducing means comprises:

a conductive member disposed between the pair of gyromagnetic resonant bodies and in electrical contact with the first and second ground plane conductors.

* * * * *